US006559798B1

(12) United States Patent
Marumoto et al.

(10) Patent No.: US 6,559,798 B1
(45) Date of Patent: May 6, 2003

(54) PHASED ARRAY ANTENNA AND METHOD OF MANUFACTURING THE SAME

(75) Inventors: Tsunehisa Marumoto, Tokyo (JP); Ryuichi Iwata, Tokyo (JP); Youichi Ara, Tokyo (JP); Hideki Kusamitu, Tokyo (JP); Kenichiro Suzuki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/869,202

(22) PCT Filed: Nov. 22, 1999

(86) PCT No.: PCT/JP99/06513

§ 371 (c)(1),
(2), (4) Date: Nov. 2, 2001

(87) PCT Pub. No.: WO00/39890

PCT Pub. Date: Jul. 6, 2000

(30) Foreign Application Priority Data

Dec. 24, 1998 (JP) ..... 10-368033

(51) Int. Cl.[7] ..... H01Q 3/22; H01Q 3/24; H01Q 3/26

(52) U.S. Cl. ..... 342/372; 342/368; 343/700 MS

(58) Field of Search ..... 342/372, 368; 343/700 MS

(56) References Cited

U.S. PATENT DOCUMENTS 5,717,231 A * 2/1998 Tserng et al. ..... 343/789
6,037,910 A 3/2000 Solbach et al.

FOREIGN PATENT DOCUMENTS

| | | |
|---|---|---|
| JP | 1290301 | 11/1989 |
| JP | 1-290301 | 11/1989 |
| JP | 5-91016 | 12/1993 |
| JP | 6-267926 | 9/1994 |
| JP | 11-74717 | 3/1999 |

* cited by examiner

*Primary Examiner*—Theodore M. Blum
(74) *Attorney, Agent, or Firm*—Young & Thompson

(57) ABSTRACT

A relatively small phased array antenna is formed at a low cost even if the number of radiating elements increases in order to improve the gain. The phased array antenna has a multilayered structure in which a number of radiating elements (15), a phase shift unit (16) for changing the phase of an RF signal transmitted/received at each radiating element, and a distribution/synthesis unit (14) are formed on different layers. Signal lines (X1–Xm) and scanning lines (Y1–Yn) are wired on a phase control layer (35) to connect phase shift units to each other in a matrix. The signal lines and the scanning lines are matrix-driven by selection units (12X, 12Y) so that desired phase shift amounts are set to phase shift units located at the intersections of the signal and scanning lines. In addition, switches (17S) of a phase shifter (17) are formed at once on the phase control layer.

33 Claims, 17 Drawing Sheets

PHASED ARRAY ANTENNA AND METHOD OF MANUFACTURING THE SAME

TECHNICAL FIELD

The present invention relates to a phased array antenna used for transmitting/receiving an RF signal such as a microwave to electrically adjust a beam radiation direction by controlling a phase supplied to each radiating element, and a method of manufacturing the antenna.

BACKGROUND ART

As a satellite tracking on-vehicle antenna or satellite borne antenna, a phased array antenna having many radiating elements arranged in an array has conventionally been proposed (see Technical Report AP90-75 of the Institute of Electronics, Information and Communication Engineers, and Japanese Patent Laid-Open No. 1-290301).

A phased array antenna of this type has a function of arbitrarily changing the beam direction by electronically changing the phase of a signal supplied to each radiating element.

As a means for changing the feed phase of each radiating element, a phase shifter is generally used.

As the phase shifter, a digital phase shifter (to be simply referred to as a phase shifter hereinafter) made up of a plurality of phase shift circuits having different fixed phase shift amounts is used.

The phase shift circuits are respectively ON/OFF-controlled by 1-bit digital control signals to combine the phase shift amounts of the phase shift circuits, thereby obtaining a feed phase of 0° to 360° by the whole phase shifter.

A conventional phased array antenna uses many components including semiconductor elements such as PIN diodes and GaAs FETs serving as switching elements in phase shift circuits, and driver circuit components for driving the semiconductor elements.

The phase shifter applies a DC current or DC voltage to these switching elements to turn them on/off, and changes the transmission path length, susceptance, and reflection coefficient to generate a predetermined phase shift amount.

Recently in the field of low earth orbit satellite communications, communications at high data rates are required along with the wide use of the Internet and the spread of multimedia communications, and the gain of the antenna must be increased.

To implement communications at high data rates, the transmission bandwidth must be increased. Because of a shortage of the frequency resource in a low-frequency band, an antenna applicable to an RF band equal to or higher than the Ka band (20 GHz or higher) must be implemented.

More specifically, an antenna for a low earth orbit satellite tracking terminal (terrestrial station) must satisfy technical performance:

Frequency: 30 GHz

Antenna gain: 36 dBi

Beam scanning range: beam tilt angle of 50° from front direction

To realize this by a phased array antenna, first, the aperture area: about 0.13 $m^2$ (360 mm×360 mm) is needed.

In addition, to suppress the side lobe, radiating elements must be arranged at an interval of about ½ wavelength (around 5 mm for 30 GHz) to avoid generation of the grating lobe.

To set a small beam scanning step and minimize the side lobe degradation caused by the quantization error of the digital phase shifter, the phase shift circuit used for the phase shifter is desirably made up of at least 4 bits (22.5° for the minimum-bit phase shifter).

The total number of radiating elements and the number of phase shift circuit bits used for a phased array antenna which satisfies the above conditions are given by Number of elements for the phase shift circuit:

72×72=about 5,000

Number of phase shift circuit bits:

72×72×4=about 20,000 bits

When a high-gain phased array antenna applicable to an RF band is to be implemented by, e.g., a phased array antenna disclosed in Japanese Patent Laid-Open No. 1-290301 shown in FIG. 19, the following problems occur.

More specifically, a conventional phased array antenna controls phase shift circuits in each phase shifter by one driver circuit, as shown in FIG. 19. For this purpose, the driver circuit must be connected to all the phase shift circuits.

This requires connection wiring lines equal in number to the number of radiating elements×the number of phase shift circuit bits. If the above numerical values are applied, the number of wiring lines to phase shift circuits (4 bits) for one line (72 radiating elements) is 72×4=288 in an array of 72×72 radiating elements.

If these wiring lines are formed on a single plane, the width of a wiring line bundle for one line (72 radiating elements) is 0.1 mm×288=28.8 mm for the wiring line width/wiring line interval (L/S)=50/50 $\mu$m.

To the contrary, in a phased array antenna applicable to a frequency of 30 GHz, radiating elements must be arranged at an interval of around 5 mm, as described above. In the prior art, however, radiating elements cannot be physically arranged because the width of the wiring line bundle is large.

Accordingly, such a prior art implements no high-gain phased array antenna applicable to an RF band.

If, as the prior art, discrete components which construct the phase shifter, e.g., switching elements and its driver circuits are individually mounted on the substrate, the number of mounting components greatly increases in accordance with an increase in number of radiating elements.

This increases a time required for mounting these components on the substrate and the manufacturing lead time, thereby increasing manufacturing cost.

The present invention has been made to solve the above problems, and has as its object to provide a high-gain phased array antenna applicable to an RF band.

DISCLOSURE OF THE INVENTION

To achieve the above object, in a phased array antenna according to the present invention, radiating elements and phase shift units are individually formed on a radiating element layer and phase control layer, respectively, and both layers are coupled by a first coupling layer to form a multilayered structure as a whole. A distribution/synthesis unit is formed on a distribution/synthesis layer, and the phase control layer and distribution/synthesis layer are coupled by a second coupling layer to form the multilayered structure as a whole. Therefore, the radiating elements and distribution/synthesis unit are eliminated from the phase control layer, thereby reducing an area in the phase control layer which is to be occupied by the radiating element and distribution/synthesis unit.

The phase shift units are connected in a matrix by signal lines and scanning lines, and the signal lines and the scanning lines are matrix-driven to set desired phase shift amounts to phase shift units located at intersections between the signal lines and the scanning lines. The signal wiring lines for controlling the phase shift units can be shared to greatly reduce the number of wiring lines.

A driver circuit constructing the phase shift unit is formed from a thin-film transistor on a glass substrate, and a micromachine switch is used in a phase shifter. This can reduce an area which is to be occupied by these circuit components in comparison with the prior art.

Accordingly, since one phase shift unit is formed in a very small area, many radiating elements are arranged, in units of several thousands, at an interval (around 5 mm) which is optimal for an RF signal of, e.g., about 30 GHz. This can implement a high-gain phased array antenna applicable to an RF band.

In addition, switching elements and circuit components used in each phase shift unit are simultaneously formed on a phase control layer (a single substrate). Therefore, as compared to a case wherein the circuit components are individually mounted as in the prior art, the numbers of mounting components, the numbers of connections, and the numbers of assembling processes can decrease, thereby reducing the manufacturing cost of the whole phased array antenna.

BEST MODE OF CARRYING OUT THE INVENTION

The present invention will be described below with reference to the accompanying drawings.

Figure 1:
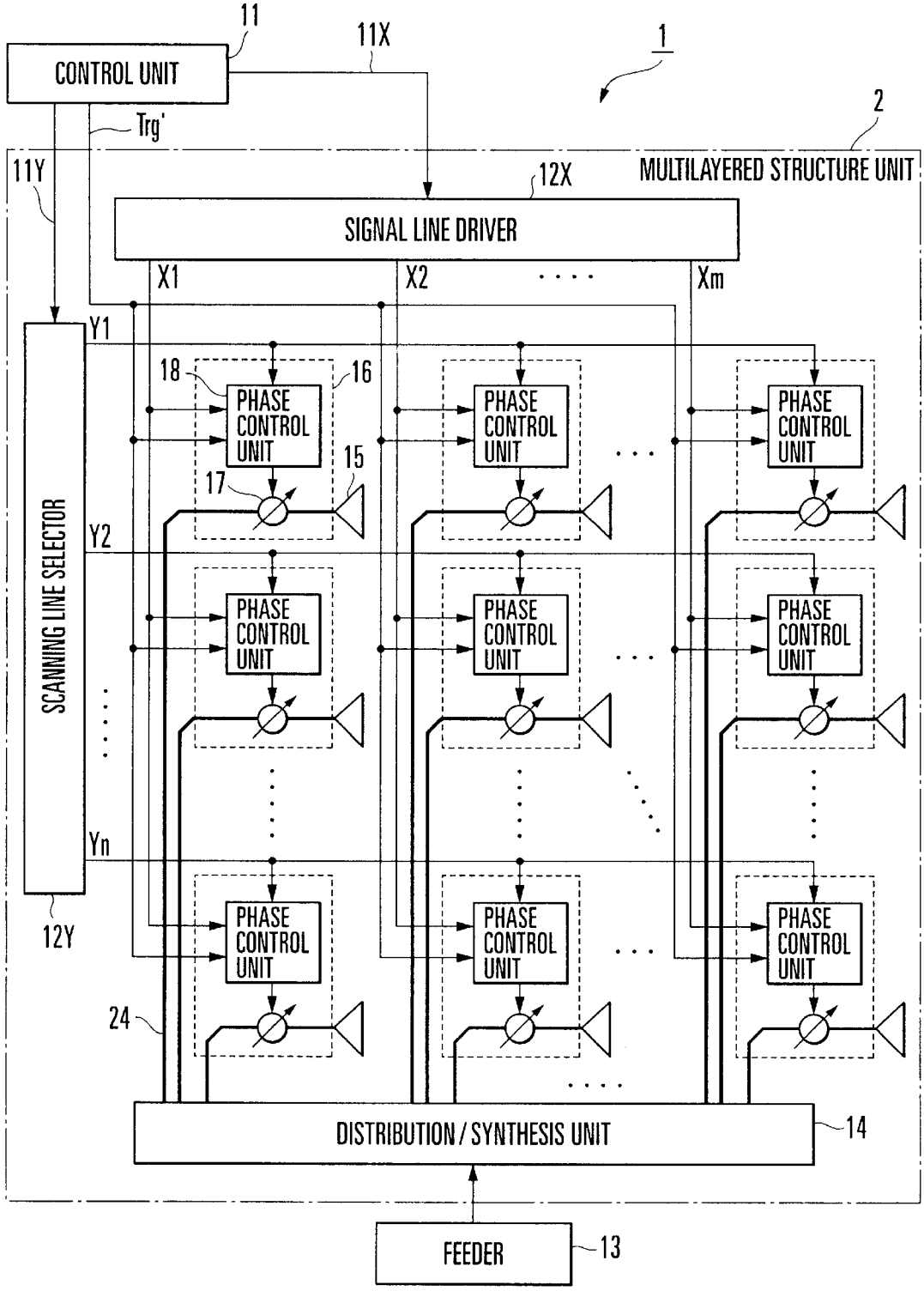
FIG. 1 is a block diagram of a phased array antenna according to an embodiment of the present invention.

FIG. 1 is a block diagram of a phased array antenna 1 according to an embodiment of the present invention.

In the following description, a phased array antenna is used as an RF signal transmission antenna. However, the phased array antenna is not limited to this, and can be used as an RF signal reception antenna for the same operation principle based on the reciprocity theorem.

In addition, when a whole antenna is made up of a plurality of subarrays, the present invention may be applied to a phased array antenna of each subarray.

FIG. 1 is a view for explaining the arrangement of the phased array antenna 1.

Referring to FIG. 1, the phased array antenna 1 is made up of a multilayered substrate unit 2 on which antenna radiating elements, phase control circuits, and the like are mounted on a multilayered substrate, a feeder 13 for feeding RF power to the multilayered substrate unit 2, and a control unit 11 for controlling the phase of each radiating element of the multilayered substrate unit 2.

In FIG. 1, m×n (m and n are integers of 2 or more) radiating elements 15 are arranged in an array, and RF signals are supplied to the radiating elements 15 from the feeder 13 via a distribution/synthesis unit 14 and strip lines 24 (thick lines in FIG. 1).

Note that, the radiating elements 15 may be arranged in a rectangular matrix shape or any other shape such as a triangular shape.

Each radiating element 15 has a phase shifter 17 and a phase controller 18 for controlling the phase shifter 17.

In the following description, the phase shifter 17 arranged for each radiating element 15, part of a strip line connected to the phase shifter 17, and the phase controller 18 will be referred to as a phase shift unit 16.

In the present invention, many phase shift units 16 (5,000 units in the aforementioned example) are simultaneously formed on the multilayered substrate unit 2 by using a semiconductor device manufacturing process.

The control unit 11 calculates the feed phase shift amount of each radiating element 15 on the basis of a desired beam radiation direction.

The calculated phase shift amount of the radiating element 15 is output from the control unit 11 to a signal line driver 12X and scanning line selector 12Y by control signals 11X and 11Y.

Signal lines X1 to Xm serving as outputs of the signal line driver 12X and scanning lines Y1 to Yn serving as outputs of the scanning line selector 12Y are connected to the phase controller 18 in a matrix.

In the signal line driver 12X and scanning line selector 12Y, therefore, the phase shift amounts of the radiating elements 15 are individually set for the phase controller 18 by performing matrix driving (to be described later) based on the control signals 11X and 11Y.

A trigger signal Trg' determines a timing in which each phase shift amount set in the phase controller 18 is designated and output to a corresponding phase shifter 17.

Therefore, after the phase shift amounts are respectively set in the phase controllers 18, the controller 11 outputs the trigger signal Trg' to simultaneously update the feed phase shift amounts to the respective radiating elements 15, thereby instantaneously changing the beam radiation direction.

Alternately, the trigger signal Trg' is always output to sequentially update the feed phases to the respective radiating elements 15.

In this case, the phase shifter 17 is not simultaneously switched but is partially switched, which avoids a hit of a radiation beam.

The multilayered substrate unit 2 of the phased array antenna according to this embodiment will be described next with reference to FIG. 2.

Figure 2:
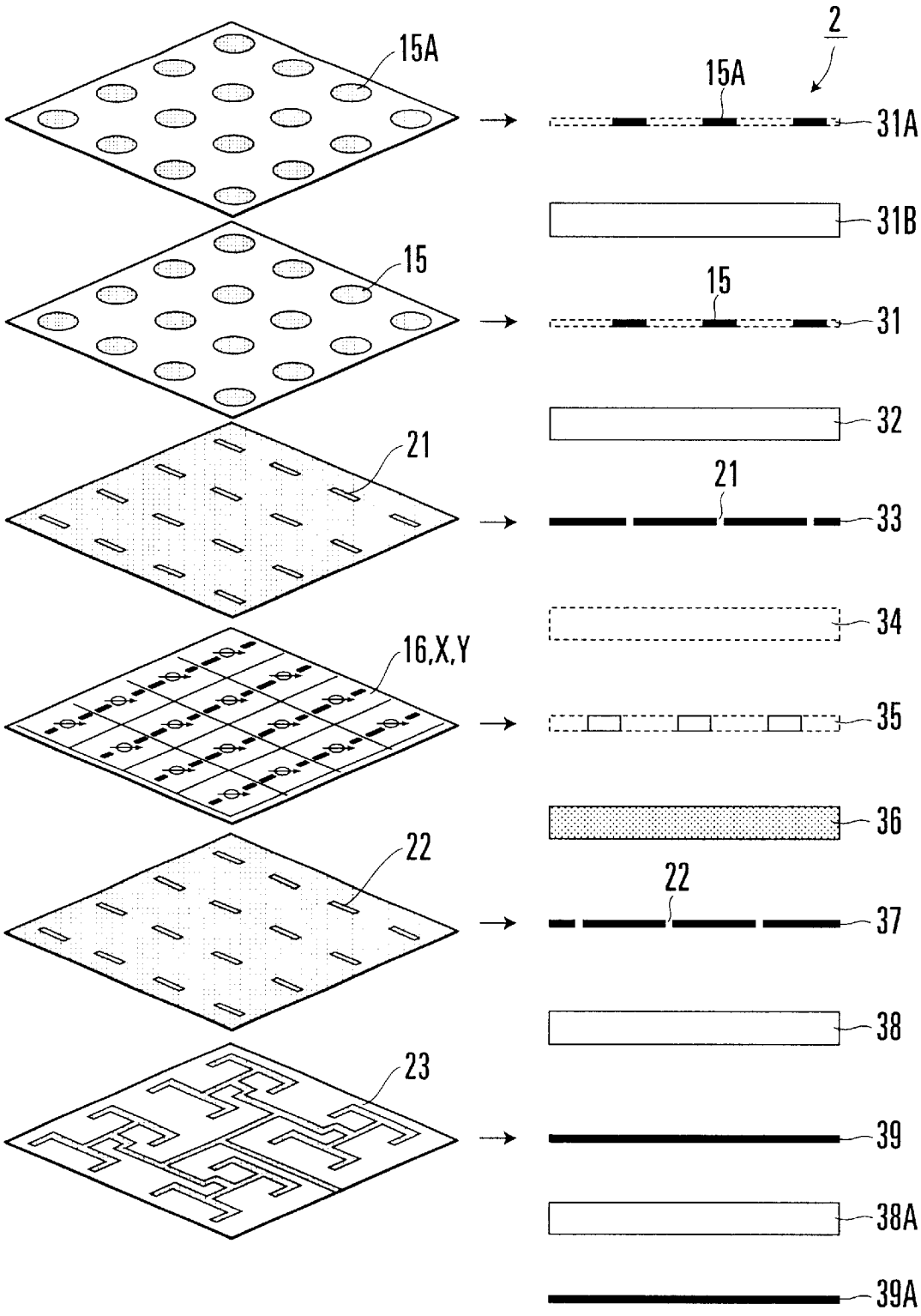
FIG. 2 is a view for explaining a multilayered substrate structure.

FIG. 2 is a view for explaining the multilayered substrate unit 2, which shows perspective views of layers and schematic views of sections.

The layers are patterned by photolithography, etching, or printing and stacked and integrated into a multilayer.

The stacking order of the respective layers is not necessarily limited to the one shown in FIG. 2. Even if the stacking order partially changes due to deletion or addition depending on the electrical/mechanical requirement, the present invention is effective.

A branch-like strip line 23 for distributing RF signals applied from the feeder 13 in FIG. 1 (not shown in FIG. 2) is formed on a distribution/synthesis layer 39.

The strip lines 23 can use a tournament scheme in which two branches are repeated or a series distribution scheme for gradually branching the main line in comb-like teeth.

A dielectric layer 38A and a ground layer 39A made of a conductor are added outside the distribution/synthesis layer 39 in accordance with a mechanical design condition such a mechanical strength or an electrical design condition such as unnecessary radiation suppression.

A coupling layer 37 (second coupling layer) is formed above the distribution/synthesis layer 39 through a dielectric layer 38.

The coupling layer 37 is comprised of a conductive pattern in which holes, i.e., coupling slots 22 are formed on a ground plane.

A phase control layer 35 is formed above the coupling layer 37 through a dielectric layer 36.

The phase control layer 35 has the phase shift units 16, and wiring lines X1 to Xm and wiring lines Y1 to Yn for individually controlling the phase shift units 16.

A coupling layer 33 (first coupling layer) having coupling slots 21 as in the coupling layer 37 is formed above the phase control layer 35 through a dielectric layer 34.

A radiating element layer 31 having the radiating elements 15 is formed above the coupling layer 33 through a dielectric layer 32.

A passive element layer 31A having passive elements 15A is formed above the radiating element layer 31 through a dielectric layer 31B.

However, the passive elements 15A are added to widen the band, and may be arranged as needed.

Each of the dielectric layers 31B, 32, and 38 is made of a material having low relative dielectric constant of about 1 to 4, e.g., a printed board, glass substrate, or foaming material.

These dielectric layers may be spaces (air layers).

As the dielectric layer 36, a semiconductor substrate (silicon, gallium arsenide, or the like) as well as a glass substrate can be used.

In particular, since the switches of the phase shifter 17 are simultaneously formed on the phase control layer 35 (to be described later), the dielectric layer 34 may be made of a space (air layer).

For the sake of descriptive simplicity, the respective layers constructing the multilayered substrate portion 2 are separately described in FIG. 2. However, a layer adjacent to each of the dielectric layers 31B, 32, 34, 36, 38, and 38A, e.g., the radiating element layer 31 or dielectric layer 32 is realized by patterning it on one or two sides of the dielectric layer.

The aforementioned dielectric layer is not made of a single material and may have an arrangement in which a plurality of materials are stacked.

In the antenna having the multilayered structure described above, the RF signal from the feeder 13 (not shown in FIG. 2) propagates from the strip line 23 of the distribution/synthesis layer 39 to the strip lines of the phase control layer 35 via the coupling slots 22 of the coupling layer 37.

The RF signal is then given a predetermined feed phase shift amount in the phase shifter 17 and propagates to the radiating elements 15 of the radiating element layer 31 via the coupling slots 21 of the coupling layer 33 to radiate from each radiating element 15 to a predetermined beam direction.

In this case, circuits (i.e., the phase shifter 17 and phase controller 18 formed for each radiating element) constructing each phase shift unit 16, the strip lines 24 for supplying the RF signal to each phase shift unit, the signal lines X1 to Xm and Y1 to Yn for electrically connecting to each phase controller the signal line driver 12X and scanning line selector 12Y that are arranged on the phase control layer 35 outside the multilayered structure region, and power and ground patterns for driving a trigger signal line Trg and all types of circuits are simultaneously formed at once through the series of manufacturing process and incorporated on the phase control layer 35.

The signal lines X1 to Xm and scanning lines Y1 to Yn are formed on the phase control layer 35 so as to intersect and connect the phase controllers 18 in a matrix.

As will be described later, the signal line driver 12X sequentially sends the driving signal via the signal lines X1 to Xm while the scanning line selector 12Y sequentially selects the scanning lines Y1 to Yn, so that desired phase shift amounts are set to the phase controllers 18 located on the intersections between the signal lines and the scanning lines.

In the present invention, the phase controllers 18 are connected in a matrix by the signal lines X1 to Xm and the scanning lines Y1 to Yn, and the signal lines X1 to Xm and the scanning lines Y1 to Yn are matrix-driven, thereby setting desired phase shift amounts to the phase controllers 18 located at intersections between the signal lines and the scanning lines.

With this arrangement, the signal wiring lines for controlling the phase controllers 18 can be shared, and the number of the wiring lines and the area need for these wiring lines can be greatly reduced.

In the present invention, the radiating elements 15 and the phase shift units 16 are individually. formed on the radiating element layer 31 and the phase control layer 35, respectively, and both layers are coupled by the coupling layer 33 to form the multilayered structure as a whole.

In addition, the distribution/synthesis unit 14 is individually formed on the distribution/synthesis layer 39, and the phase control layer 35 and distribution/synthesis layer 39 are coupled by the coupling layer 37 to form the multilayered structure as a whole.

This reduces the area, of the phase control layer 35, which is to be occupied by the radiating elements 15 and distribution/synthesis unit 14 and can make an area per radiating element small.

Accordingly, one phase shift unit 16 is formed in a relatively small area. For this reason, e.g., for the RF signal of about 30 GHz, the radiating elements 15 can be arranged at an optimum interval of around 5 mm, thereby realizing the high-gain phased array antenna applicable to an RF band.

In addition, a beam scanning angle in which the grating lobe is generated is made large by realizing the optimum element interval, thereby scanning a beam within a wide range centered on the front direction of the antenna.

In the present invention, the phase shifter 17, phase controller 18, control signal lines, power wiring lines, and strip lines 24 are formed at once on the phase control layer 35. Accordingly, as compared to the case in which the circuit components are individually mounted as in the prior art, the number of separately mounted components, the number of connections, and the number of assembling processes can be decreased, thereby reducing the manufacturing cost of the whole phased array antenna.

As the strip line used in the present invention, a triplet type, coplanar waveguide type, slot type, or the like as well as a microstrip type distributed constant line can be used.

As the radiating element 15, a printed dipole antenna, slot antenna, aperture element or the like as well as a patch antenna can be used. In particular, the opening of the coupling slot 21 of the coupling layer 33 is made large, which is usable as a slot antenna. In this case, the coupling layer 33 also serves as the radiating element layer 31, and the radiating element layer 31 and passive element layer 31A can be omitted.

In place of the coupling slots 21, conductive feed pins for connecting the strip lines of the phase control layer 35 and the radiating elements 15 may be used to couple the RF signals.

Further, in place of the coupling slots 22, conductive feed pins projecting from the strip lines of the phase control layer 35 to the dielectric layer 38 through holes formed in the coupling layer 37 may be used to couple the RF signals.

The same function as that of the distribution/synthesis layer 39 can also be realized even if a radial waveguide is used.

Figure 3:
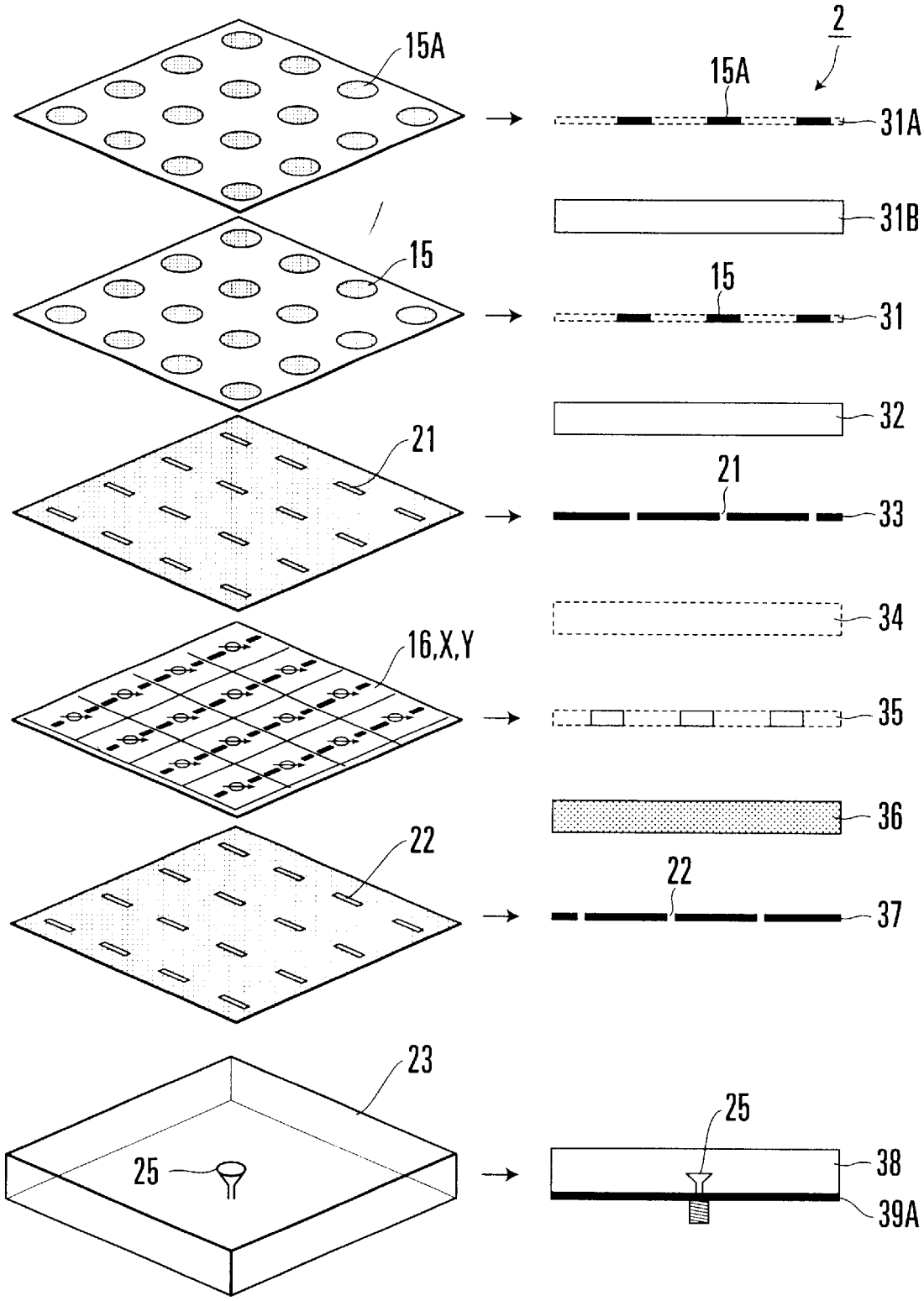
FIG. 3 is a view for explaining a multilayered substrate structure according to another embodiment of the present invention.

FIG. 3 is a view for explaining the arrangement of the present invention when using the radial waveguide.

In this case, a distribution/synthesis function is realized by a dielectric layer 38, ground layer 39A, and probe 25 of a multilayered substrate unit 2 shown in FIG. 3, and a distribution/synthesis layer 39 required in FIG. 2 can be omitted.

In this case, the dielectric layer 38 is also made of a printed board, glass substrate, foaming agent, or space (air layer).

As the ground layer 39A, the copper foil on a printed board may be directly used, or a metal plate or a metal enclosure for enclosing all the side surfaces of the dielectric layer 38 may be separately arranged.

The present invention can also be applied to a space-fed phased array antenna.

Figure 4:
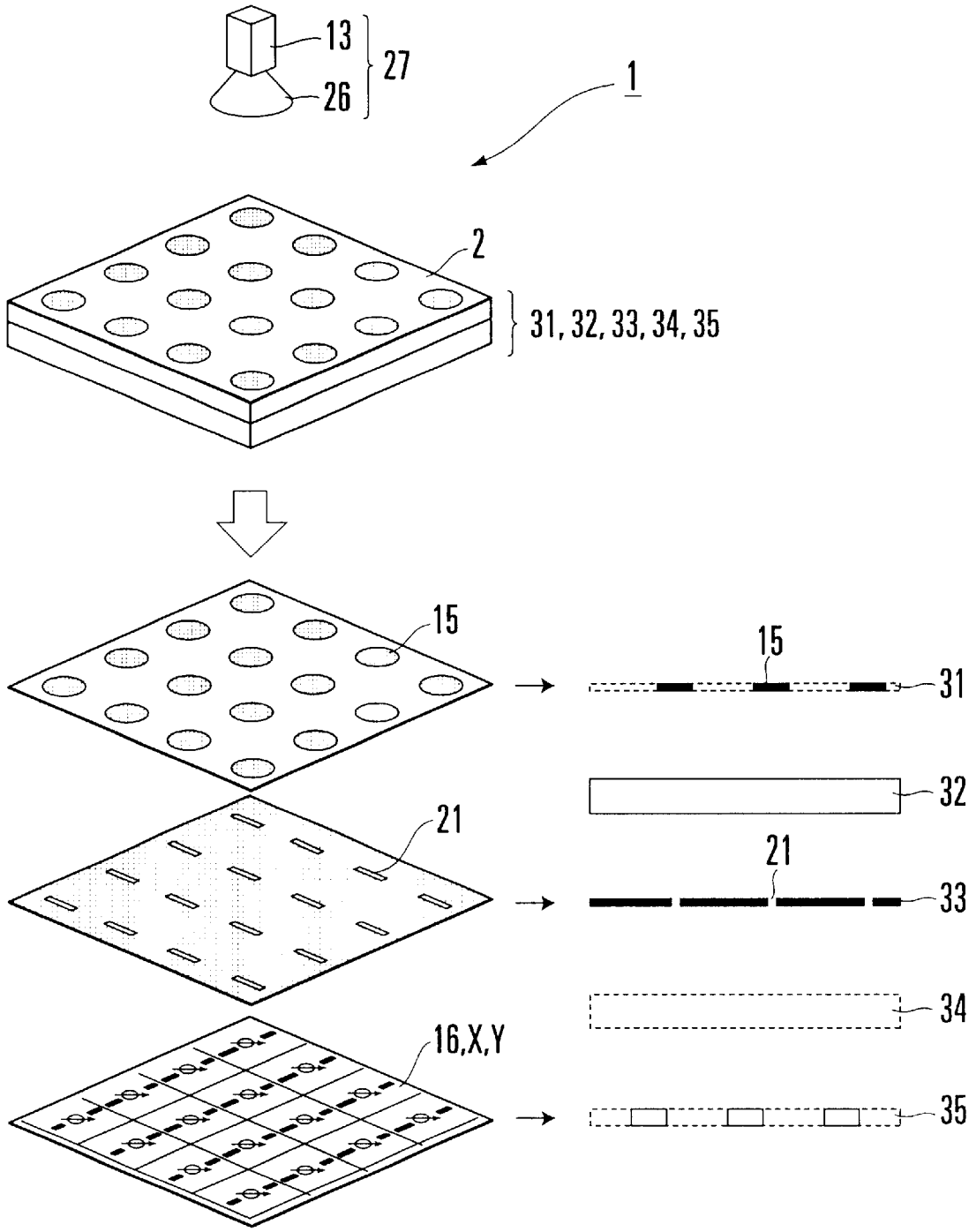
FIG. 4 is a view for explaining a multilayered substrate structure according to still another embodiment of the present invention.

FIG. 4 shows the arrangement of a reflection-type space-fed phased array antenna as an example.

A phased array antenna 1 shown in FIG. 4 is made up of a feeder 13, a radiation feeder 27 having a primary radiation unit 26, a multilayered substrate unit 2, and a control unit 11 (not shown).

In this structure, the multilayered substrate unit 2 has a structure different from that shown in FIG. 2, which is constructed by a radiating element layer 31, dielectric layer 32, coupling layer 33, dielectric layer 34, and phase control layer 35.

The function of the distribution/synthesis unit 14 shown in FIG. 1 is realized by the primary radiation unit 26 so that a distribution/synthesis layer 39 is excluded from the multilayered substrate unit 2.

In the phased array antenna 1, an RF signal radiated from the radiation feeder 27 is temporarily received by each radiating element 15 on the radiating element layer 31, and is coupled to each phase shift unit 16 on the phase control layer 35 via the coupling layer 33.

After the phase of the RF signal is controlled by each phase shift unit 16, the RF signal propagates to each radiating element 15 again via the coupling layer 33, and radiates from each radiating element 15 in the predetermined beam direction.

The present invention is effective even for the space-fed phased array antenna as described above which includes no distribution/synthesis layer 39 in the multilayered substrate unit 2.

The phase shift unit 16 formed for each radiating element 15 will be described next with reference to FIG. 5.

Figure 5:
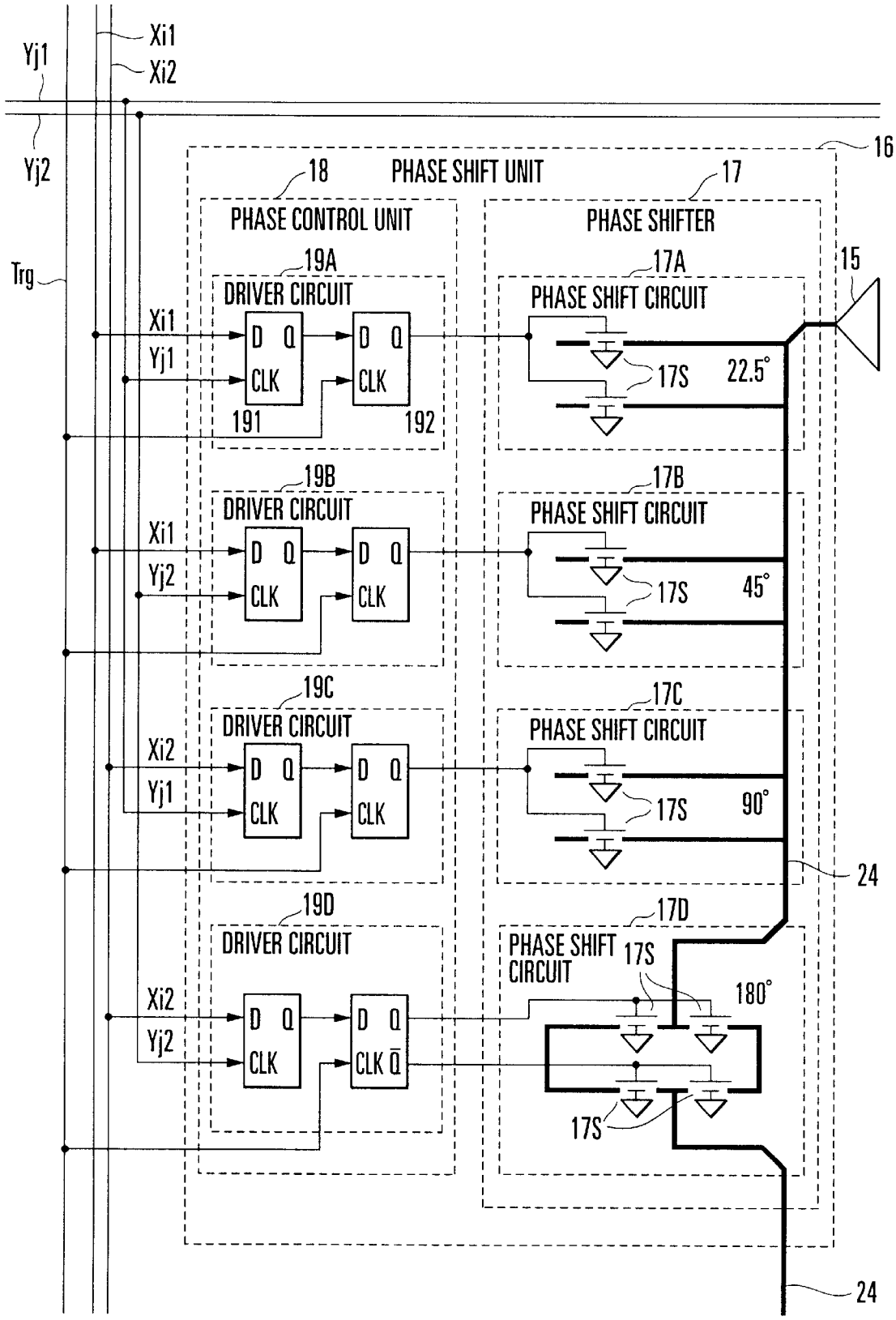
FIG. 5 is a block diagram showing a phase shift unit.

FIG. 5 is a block diagram showing the phase shift unit. In this case, the phase shifter 17 is comprised of four phase shift circuits 17A to 17D having different phase shift amounts of 22.5°, 45°, 90°, and 180°.

The phase shift circuits 17A to 17D are connected to the strip line 24 for propagating an RF signal from the distribution/synthesis unit 14 to the radiating element 15.

Each of the phase shift circuits 17A to 17D has a switch 17S.

By switching the internal switches of the switch 17S, a predetermined feed phase shift amount is supplied, as will be described below.

The phase controller 18 for individually controlling the switches 17S of the phase shift circuits 17A to 17D is constituted by driver circuits 19A to 19D respectively arranged for the phase shift circuits 17A to 17D.

Each of the driver circuits 19A to 19D has two series-connected latches 191 and 192.

Of these latches, the latches (first latches) 191 latch the levels of signal lines Xi connected to the inputs D at the leading edge timings of scanning lines Yi connected to the inputs CLK.

The latches (second latches) 192 latch the outputs Q of the latches 191 at the leading edge of the trigger signal Trg' supplied to the inputs CLK, and output the outputs Q to the switches 17S of corresponding phase shift circuits.

In FIG. 5, two signal lines Xi1 and Xi2 and two scanning lines Yj1 and Yj2 are laid out for one phase controller 18, and ON/OFF data of the respective switches are individually set in the four driver circuits 19A to 19D.

That is, Xi1 and Yj1 control the operation of the phase shift circuit 17A; Xi1 and Yj2, that of the phase shift circuit 17B; Xi2 and Yj1, that of the phase shift circuit 17C; and Xi2 and Yj2, that of the phase shift circuit 17D.

Figure 6:
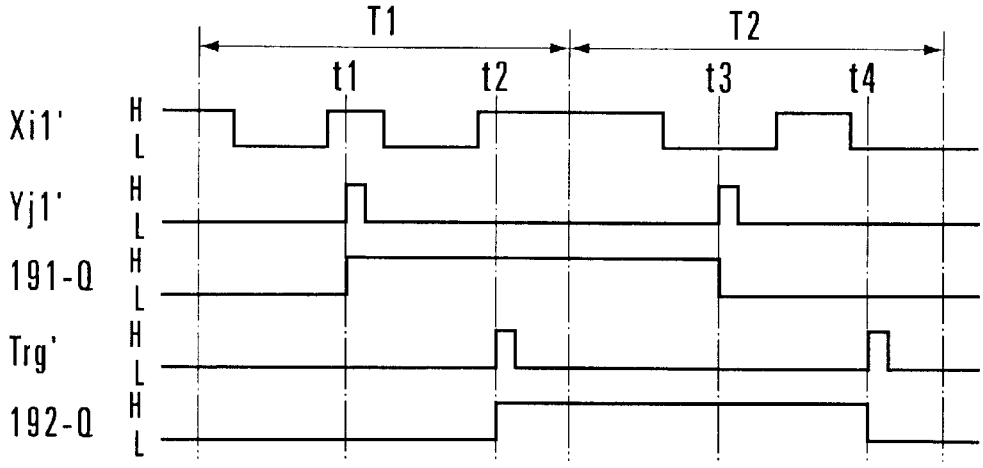
FIG. 6 is a timing chart showing an operation of a phase controller.

FIG. 6 is a timing chart showing the operation of the phase controller by exemplifying the driver circuit 19A corresponding to the phase shift circuit 17A.

The signal line driver 12X in FIG. 5 always changes because the signal line driver 12X supplies not only a signal for the driver circuit 19A as a driving signal applied to the signal line Xi1, but also signals for other driver circuits connected to the signal line Xi1, i.e., the driver circuit 19B of the same phase. controller 18 and the driver circuit of another phase controller 18.

Figure 7:
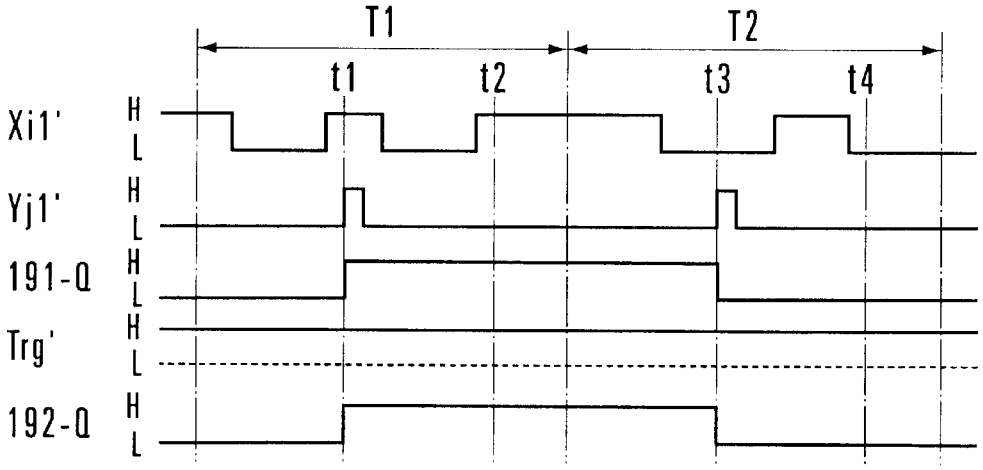
FIG. 7 is a timing chart showing another operation of the phase controller.

Since the scanning line selector 12Y sequentially selects Y11 to Yn2 one by one during a period T1, the scanning line Yj1 receives a pulse only once during the period T1 (t1 in FIG. 7).

When a scanning line voltage Yj1' changes to high level at time t1 during the period T1, the level of a signal line voltage Xi1', i.e., high level, is output from the output Q of the latch 191. This state is held even after the scanning line voltage Yj1' returns to low level.

After that, when the trigger signal Trg' changes to high level at time t2, the output Q of the latch 191 is output from the output Q of the latch 192. This state is held even after the trigger signal Trg' returns to low level.

Accordingly, the switch 17S of the phase shift circuit 17A is kept on from t2 to t4 (at which the trigger signal Trg' is applied next) during which a feed phase of +22.5° is applied to an RF signal propagating through the strip line 24.

During the period T2, the low level of the signal line voltage Xi1' is latched by the latch 191 at time t3, and by the latch 192 at time t4.

Then, the switch 17S of the phase shift circuit 17A is kept off, and the feed phase shift amount to an RF signal propagating through the strip line 24 returns to 0°.

As shown in FIG. 7, the trigger signal Trg' may always be kept high. In this case, the latch output Q of the latch 191 is quickly transferred to the latch 192, and output to the switch 17S.

By sequentially switching the switches 17S, a hit of a radiation beam caused by a switching time can be avoided, and stable operation can always be ensured.

If the output voltage or current of the latch 192 is not high enough to drive the switch 17S, a voltage amplifier or current amplifier may be arranged on the output side of the latch 192.

A structure of the switch 17S will be described with reference to FIG. 8 while using an example of practical sizes.

Figure 8:
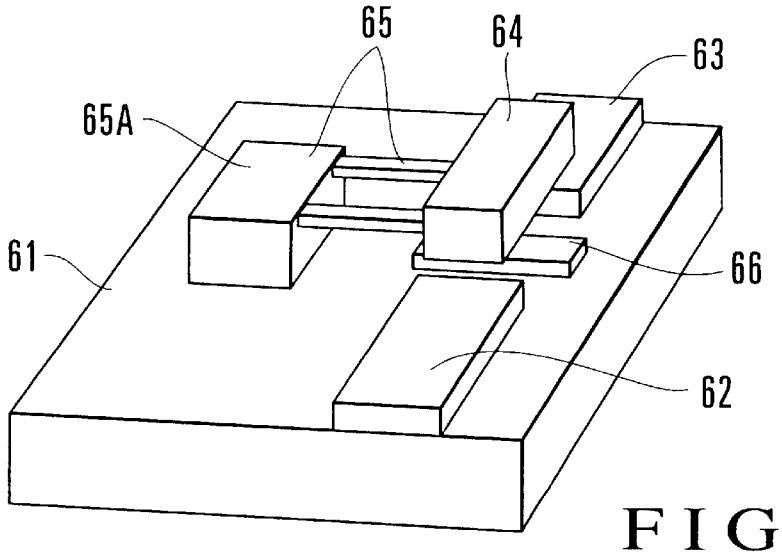
FIG. 8 is a perspective view showing a structure of a switch.
Figure 9A:
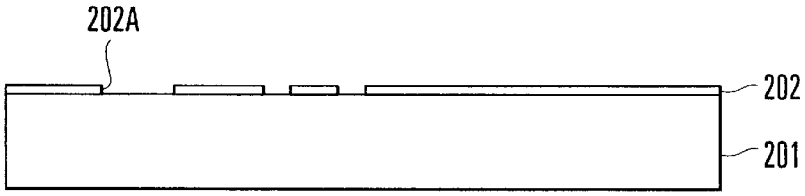
FIGS. 9A–9F shows views for explaining a method of forming a phase unit according to still another embodiment of the present invention.
Figure 9B:
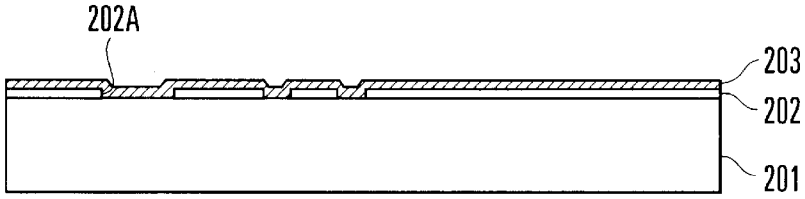
Figure 9C:
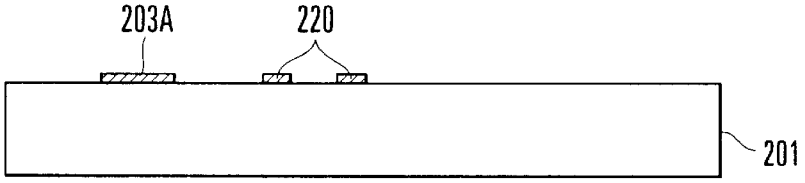
Figure 9D:
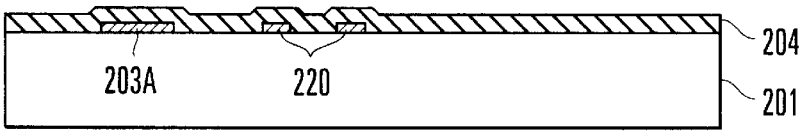
Figure 9E:
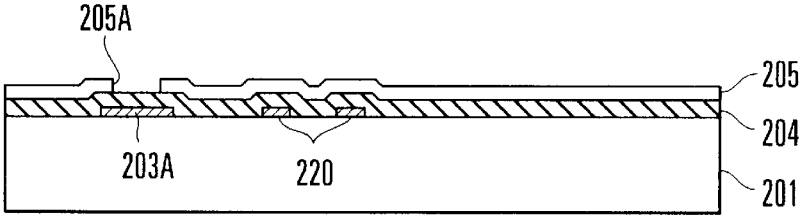
Figure 9F:
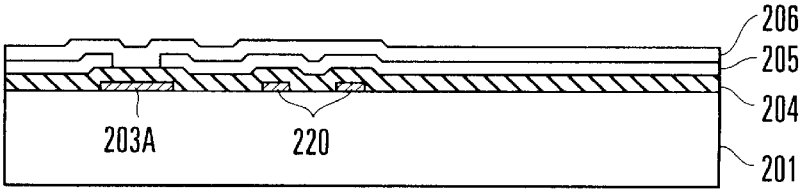
Figure 10G:
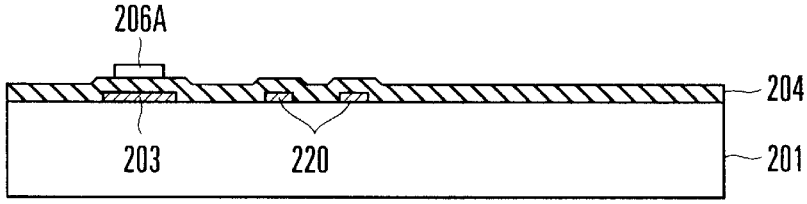
FIGS. 10G–10K shows views for explaining another method of forming a phase unit according to still another embodiment of the present invention.
Figure 10H:
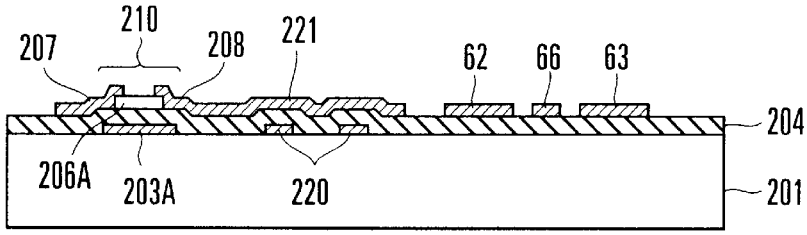
Figure 10I:
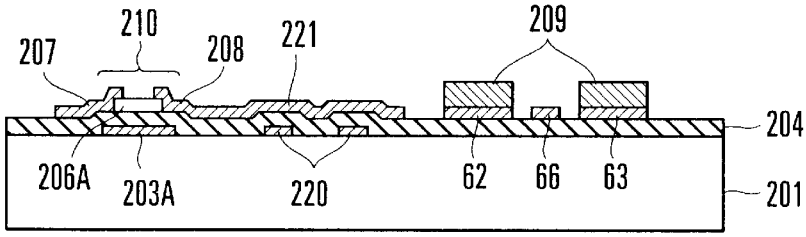
Figure 10J:
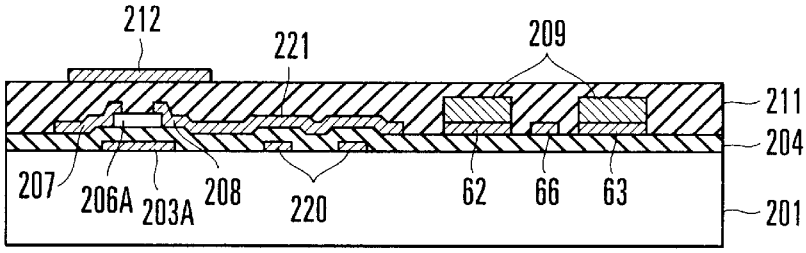
Figure 10K:
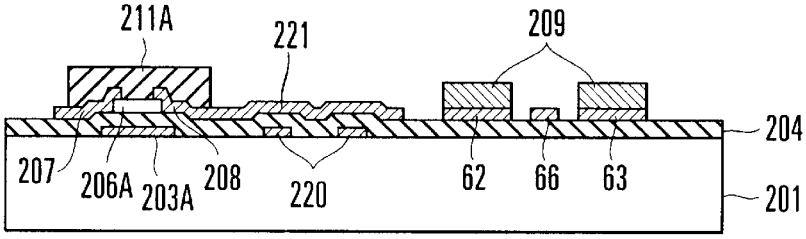

FIG. 8 is a perspective view showing the structure of the switch.

This switch is comprised of a micromachine switch for short-circuiting/releasing strip lines 62 and 63 by a contact (small contact) 64. The "micromachine switch" means a small switch suitable for integration by a semiconductor device manufacturing process.

The strip lines (first and second strip lines) 62 and 63 (about 1 μm thick) are formed on a substrate 61 at a small gap. The contact 64 (about 2 μm thick) is supported by a support member 65 above the gap so as to freely contact the strip lines 62 and 63.

The distance between the lower surface of the small contact 64 and the upper surfaces of the strip lines 62 and 63 is about 4 μm. The level of the upper surface of the small contact 64 from the upper surface of the substrate 61, i.e., the height of the whole micromachine switch is about 7 μm.

A conductive electrode 66 (about 0.2 μm thick) is formed at the gap between the strip lines 62 and 63 on the substrate 61. The height (thickness) of the electrode 66 is smaller than that of the strip lines 62 and 63.

The operation of the switch will be explained.

The electrode 66 receives an output voltage (e.g., about 10 to 100 V) from a corresponding one of the driver circuits 19A to 19D.

When a positive output voltage is applied to the electrode 66, positive charges are generated on the surface of the electrode 66. At the same time, negative charges appear on the surface of the facing contact 64 by electrostatic induction, and are attracted to the strip lines 62 and 63 by the attraction force between the positive and negative charges.

Since the contact 64 is longer than the gap between the strip lines 62 and 63, the contact 64 contacts both the strip lines 62 and 63, and the strip lines 62 and 63 are electrically connected in a high-frequency manner through the contact 64.

When application of the output voltage to the electrode 66 stops, the attraction force disappears, and the contact 64 returns to an original apart position by the support member 65 to release the strip lines 62 and 63.

In the above description, the output voltage is applied to the electrode 66 without applying any voltage to the contact 64. However, the operation may be reversed.

That is, the output voltage of the driver circuit may be applied to the contact 64 via the conductive support member 65 without applying any voltage to the electrode 66. Even in this case, the same effects as those described above can be attained.

At least the lower surface of the contact 64 may be formed from a conductor so as to ohmic-contact the strip lines 62 and 63. Alternatively, an insulating thin film may be formed on the lower surface of the conductive member so as to capacitively couple the strip lines 62 and 63.

In the micromachine switch, the contact 64 is movable. When the phase control layer 35 is formed on a multilayered substrate, like a phased array antenna, a space for freely moving the contact 64 must be defined.

In this manner, since the micromachine switch is used as the switching element for controlling the feed phase, the power consumption at the semiconductor junction can be eliminated as compared with the use of a semiconductor device such as a PIN diode. This makes it possible to reduce the power consumption to about 1/10.

A formation means of circuit components of the phase shift unit 16 incorporated in the phase control layer 35 will be described next.

Figure 11L:
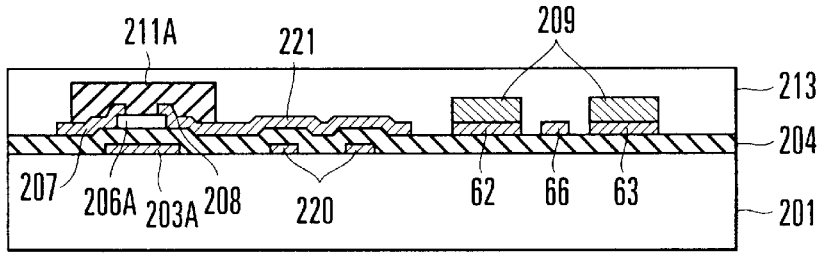
FIGS. 11L–11N shows views for explaining still another method of forming a phase unit according to still another embodiment of the present invention.
Figure 11M:
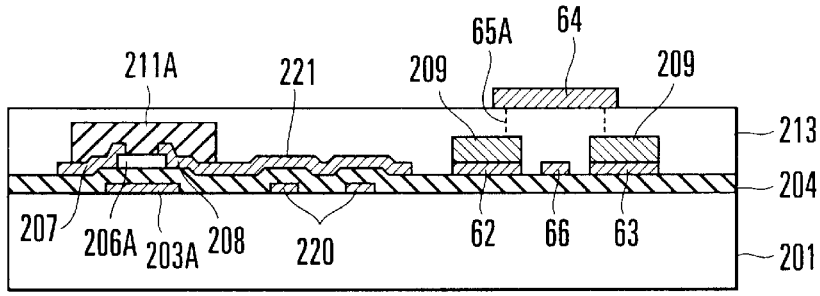
Figure 11N:
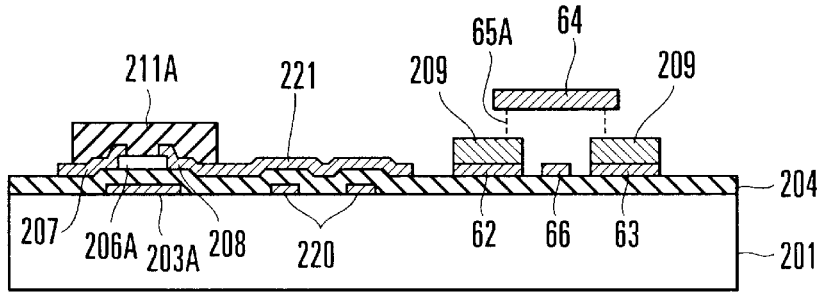

FIGS. 9 to 11 show a case in which the phase control unit 18 (not shown) and the switch 17S (micromachine switch in this case) are simultaneously formed by applying a semiconductor element manufacturing process, and particularly, by applying a means for forming a thin film transistor (TFT) onto a glass substrate as an example of the means for forming a circuit component.

First, a glass substrate 201 whose surface is accurately polished to have flatness Ra=about 4 to 5 nm is prepared, and a photoresist is applied onto the glass substrate 201.

The glass substrate 201 is patterned by known photolithography, and a resist pattern 202 having grooves 202A at predetermined portions is formed on the glass substrate 201, as shown in FIG. 9(*a*).

As shown in FIG. 9(*b*), a metal film 203 made of chromium, aluminum or the like is formed on the resist pattern 202 having the grooves 202A by sputtering.

The resist pattern 202 is removed by a method, e.g., dissolving it in an organic solvent to selectively remove (lift off) the metal film 203 on the resist pattern 202, thereby forming a gate electrode 203A and wiring patterns 220 on the glass substrate 201, as shown in FIG. 9(*c*).

As shown in FIG. 9(*d*), silicon oxide or the like is grown on the glass substrate 201 by sputtering so as to cover the gate electrode 203A and wiring patterns 220, thereby forming an insulating film 204.

A photoresist is applied onto the insulating film 204 and patterned by known photolithography. As shown in FIG. 9(*e*), a resist pattern 205 having an opening 205A is formed on the gate electrode 203A.

As shown in FIG. 9(*f*), a silicon film 206 is formed on the resist pattern 205 by sputtering so as to bury the opening 205A.

The resist pattern 205 is removed by a method, e.g., dissolving it in an organic solvent, thereby forming a semiconductor. layer 206A on a part of the insulating film 204 on the gate electrode 203A, as shown in FIG. 10(*g*).

With this processing, the gate electrode 203A is arranged below the semiconductor layer 206A through the insulating film 204.

After a source and drain are formed with respect to the semiconductor layer 206A, a drain electrode 207 and source electrode 208 are formed on the insulating film 204, as shown in FIG. 10(*h*).

With this processing, a thin-film transistor (MOS) 210 comprised of the semiconductor layer 206A, insulating film (gate insulating film) 204, gate electrode 203A, drain electrode 207, and source electrode 208 is formed.

Column portion electrodes (not shown) of the support member 65, the strip lines 62 and 63, and the electrode 66 of the switch 17S are simultaneously formed at a predetermined portion near the electrodes of the thin-film transistor 210 at the same time these electrodes are formed.

Note that, as a patterning method, a lift-off method may be used similarly to the case wherein the gate electrode 203 is formed.

Next, as shown in FIG. 10(*i*), a metal film 209 made of gold or the like is selectively grown on the strip lines 62 and 63.

With this processing, the wiring resistance decreases to reduce the propagation loss in an RF band while an air gap is ensured between the contact 64 and the electrode 66 to avoid short-circuiting therebetween even if the contact 64 is displaced to a position where the strip lines 62 and 63 are electrically connected in a high-frequency manner.

As shown in FIG. 10(*j*), an insulating film 211 made of a silicon oxide film or the like is formed by sputtering so as to cover the whole substrate 201.

A mask pattern 212 made of a metal is formed in a region on the insulating film 211 by lift-off.

The region is etched by using the mask pattern 212 as a mask by dry-etching, thereby forming a protective film 211A made of the insulating film 211 on the thin-film transistor 210, as shown in FIG. 10(*k*).

With this processing, the semiconductor layer 206A is sealed by the protective film 211A, thereby obtaining the stable operation of the thin-film transistor 210.

As shown in FIG. 11(*l*), polyimide or the like is applied, dried, and harden on the entire surface of the substrate 201 to form a sacrificial layer 213 about 5 to 6 $\mu$m thick.

An opening (not shown) is formed at the position, where the column of the support member 65 of the switch 17S is to be formed, by known photolithography and etching to form a column portion made of a metal so as to fill the opening with it.

Then, as shown in FIG. 11(*m*), the arm portion of the support member 65 and the contact 64 are formed by lift-off at a position across a column portion 65A and a portion above the strip lines 62 and 63.

With this processing, the arm portion of the support member 65 and the contact 64 are electrically connected to the column portion of the support member 65.

As shown in FIG. 11(*n*), only the sacrificial layer 213 is selectively removed by dry-etching using oxygen gas plasma.

With this processing, the aforementioned micromachine switch (switch 17S) (FIG. 8) and the thin-film transistor 210 are simultaneously formed on the glass substrate 201, i.e., the phase control layer 35.

The above example has described the means for simultaneously forming the thin-film transistor 210 of the phase controller 18 and switch 17S on the glass substrate. However, the means for forming the circuit components of the phase shift unit 16 of the present invention is not limited to this, and the switch 17S can be separately formed after forming the thin-film transistor on the glass substrate.

In addition, a semiconductor substrate can be used in place of the glass substrate 201, and the switch 17S can be separately formed after forming the same active element as that in the aforementioned example on a semiconductor substrate by impurity diffusion.

As described above, in the present invention, all circuit components of the phase controller 18 are simultaneously formed on a single surface of the phase control layer 35 in the single process by using a semiconductor device manufacturing process. This reduces the number of components to be individually mounted and the number of connections, thereby reducing the number of assembling processes. As a result, the manufacturing cost of the whole phased array antenna can be greatly reduced.

A method of mounting the switch used in the phase shifter will be described next with reference to FIG. 12.

In the present invention, many switches of the phase shifter are simultaneously formed on the single substrate in the phase control layer 35 which is stacked in the multilayered structure.

Figure 12A:
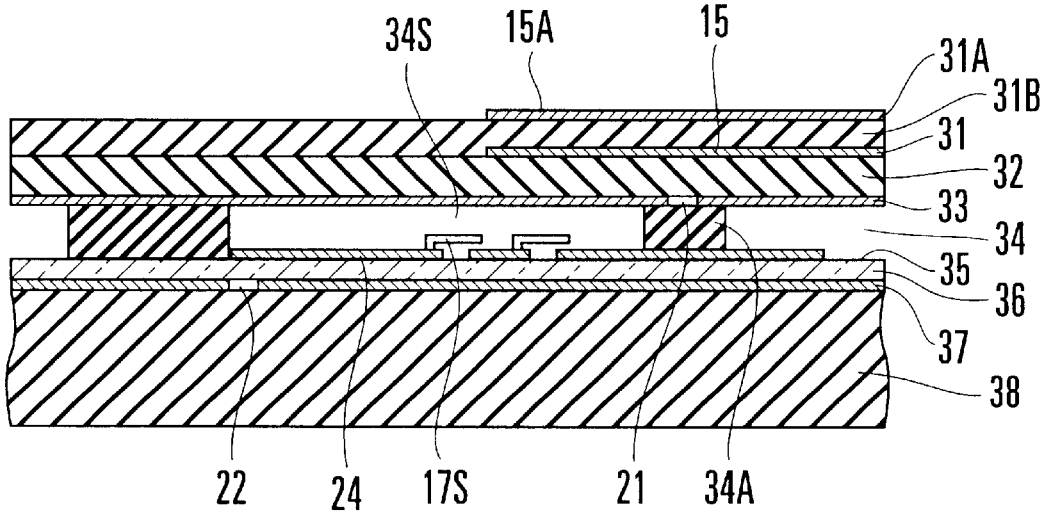
FIGS. 12A and 12B show views for explaining an example of mounting a switch.
Figure 12B:
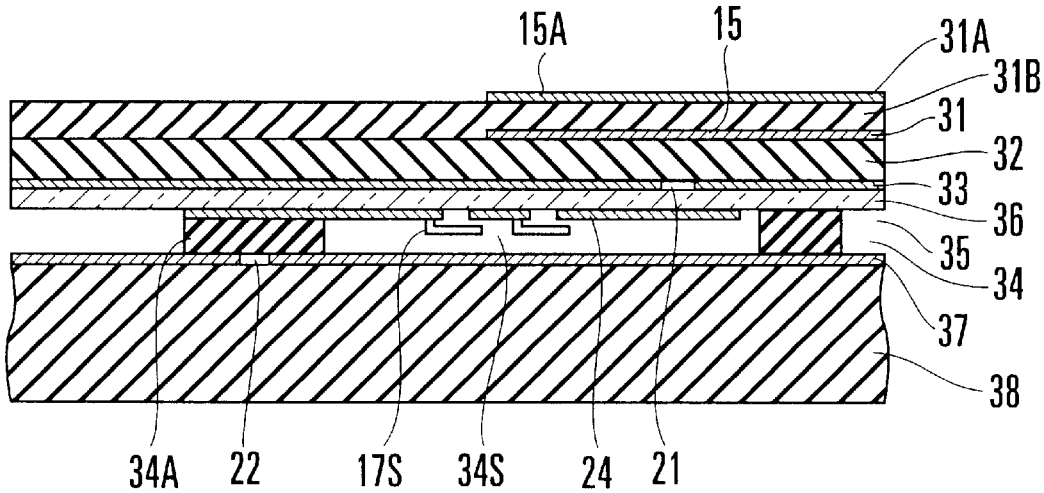

FIG. 12 shows views for explaining an example of mounting the switch by exemplifying a case wherein a mounting space for the switch is formed by a spacer serving as a separate component, in which FIG. 12(*a*) shows a case wherein a space is ensured above the switches, and FIG. 12(*b*) shows a case wherein a space is ensured below the switches.

In FIG. 12(*a*), the phase control layer 35 is formed on the dielectric layer 36, and the switches 17S used in the phase shifter 17 (micromachine switches in this case) is formed at once on the phase control layer 35.

As the dielectric layer 36, a semiconductor substrate (silicon, gallium arsenide) as well as the glass substrate (relative dielectric constant: about 4 to 8) can be used.

The thin film of the phase control layer 35 is formed by vacuum deposition or sputtering as described above, and the pattern is formed by using a metal mask or photoetching.

In particular, the two latches 191 and 192 of each of the driver circuits 19A to 19D are made of the thin-film transistors (TFT) on the dielectric layer 36.

As described above, when the switch 17S having a movable portion such as the contact of the micromachine switch is used, a space for mounting the switch need be ensured.

In this example, the mounting space has a space 34S (internal space) formed between the phase control layer 35 and coupling layer 33, and the space 34S is formed by forming a spacer 34A serving as a separate component.

In this case, the spacer 34A may be arranged below the coupling slot 21. With this arrangement, a space immediately under the coupling slot 21, which is generally an unused region, also serves as a region in which the spacer 34A is arranged, thereby reducing the area occupied by the spacer 34A.

As the spacer 34A, a material having high relative dielectric constant of about 5 to 30 such as alumina may be used and arranged under the coupling slot 21. Thus, the coupling slot 21 and the strip line 24 on the phase control layer 35 are efficiently coupled in a high-frequency manner.

The spacer 34A may be formed on the dielectric layer 36 at a position immediately above a via hole (electrically connecting hole) in which the upper and lower surfaces are electrically connected, and may be electrically connected to ground patterns, e.g., the conductive patterns of the coupling layers 33 and 37.

In FIG. 12(*b*), as compared to FIG. 12(*a*) described above, the stacking order of the dielectric layer 36, phase control layer 35, and dielectric layer 34 is reversed.

More specifically, the upper side of the dielectric layer 36 closely contacts the coupling layer 33, the spacer 34A is formed between the phase control layer 35 on the lower side of the dielectric layer 36 and coupling layer 37, and the dielectric layer 34 is formed by the space 34S.

Therefore, the micromachine switch of the switch 17S has a shape enough to ensure a space 34S below the phase control layer 35.

Another method of mounting the switch used in the phase shifter will be described next with reference to FIG. 13.

Figure 13A:
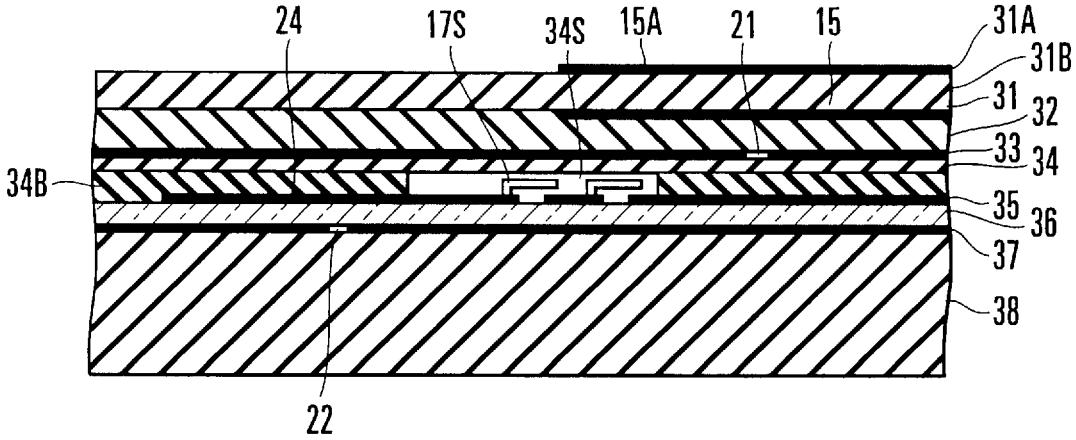
FIGS. 13A–13C show views for explaining another example of mounting the switch.
Figure 13B:
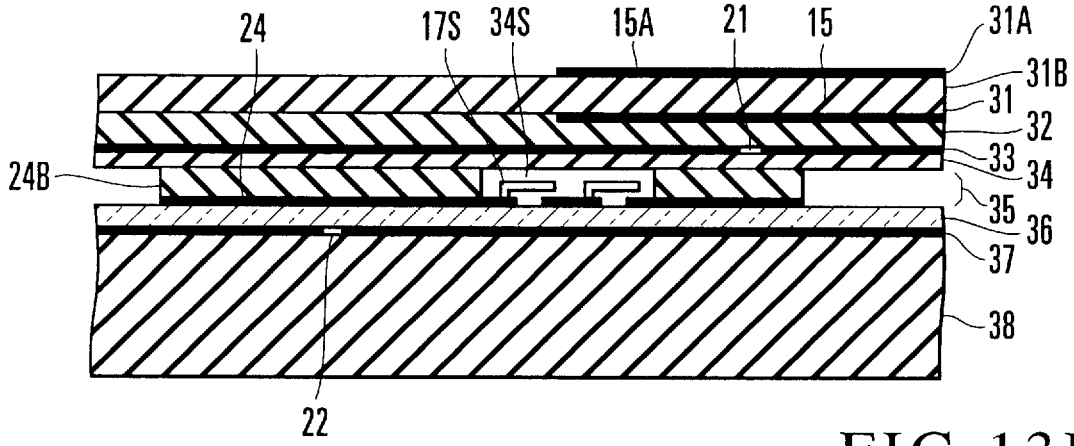
Figure 13C:
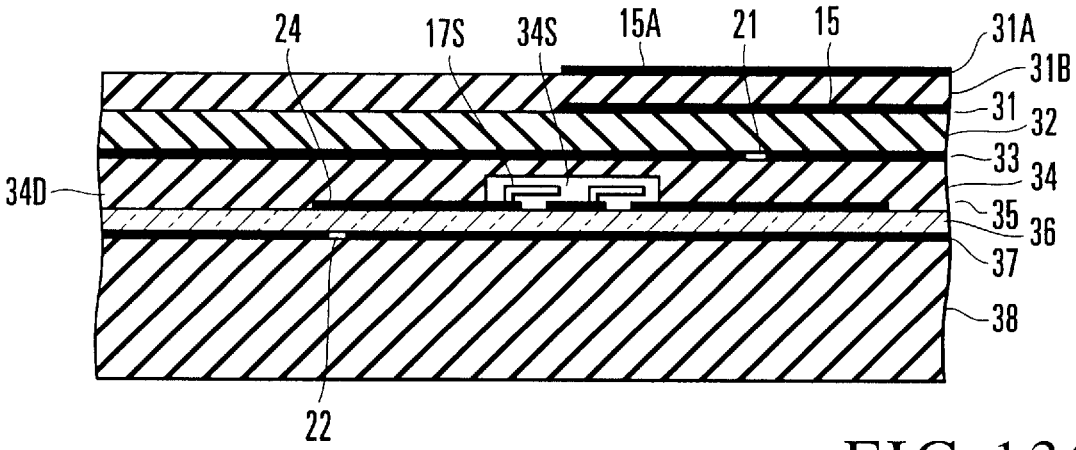

FIG. 13 shows views for explaining another example of mounting the switch, in which a mounting space for the switch is formed by various types of members.

FIG. 13(*a*) shows a case wherein the space 34S serving as the mounting space for the switch 17S is formed by a dielectric film 34B.

In this case, after a dielectric film is added on the sacrificial layer 213 used in forming the switch 17S, the additive dielectric film and a part of the sacrificial layer 213 are selectively removed, thereby forming the dielectric film 34B having a thickness larger than the height of the switch 17S.

By using a photosensitive adhesive as the dielectric film 34B, it can also serve as an adhesive in the sequential substrate stacking process.

FIG. 13(*b*) shows a case wherein the space 34S serving as the mounting space for the switch 17S is formed by forming the wiring pattern conductor on the phase control layer 35 thick.

In a method of forming the wiring pattern conductor thick, the switch 17S is protected and plated thick with a metal by electrolytic plating or the like.

As the wiring pattern conductor, the strip line 24 having a relatively large width or a spacer-dedicated wiring pattern having a large area is used which is separately formed, thereby obtaining a stable mounting space.

FIG. 13(*c*) shows a case wherein the space 34S serving as the mounting space for the switch 17S is formed by using a substrate 34D having a cavity (space) 34E.

In this case, the cavity 34E is formed in the substrate 34D so as to correspond to the position of the switch 17S mounted on the phase control layer 35.

The substrate 34D is stacked between the phase control layer 35 and coupling layer 33 as the dielectric layer 34.

Note that the substrate having relative low dielectric constant (relative dielectric constant: about 1 to 4) is used as the substrate 34D.

The cavity 34E may be formed by cutting the surface of the substrate 34D by machining. Alternatively, the cavity 34E may be formed by forming a through hole by punching or the like.

After a photosensitive resin is applied on an organic substrate, the resin corresponding to the cavity 34E may be removed by exposing and developing processes. Various types of the formation methods are usable.

EXAMPLE

Examples 1 to 5 (examples of arrangements for each radiating element) will be described below with reference to FIGS. 14 to 18, in which the present invention is applied to a 30-GHz phased array antenna.

A case wherein a phase shifter 17 is made up of four phase shift circuits 17A to 17D having different phase shift amounts of 22.5°, 45°, 90°, and 180° will be described below.

In the examples cited in FIGS. 14 to 18, each of driver circuits 19A to 19D is arranged near a corresponding phase shift circuit. However, driver circuits corresponding to one phase shift unit may be integrated and arranged at one place. Alternatively, a predetermined number of driver circuits corresponding to the plurality of phase shift circuits may be integrated at one place.

Assuming that a micromachine switch is used as the switching element of the phase shift circuit.

The sizes to be described below are merely examples for 30 GHz, and change depending on the change in frequency. However, other sizes can be used for 30 GHz.

Example 1 will be described first with reference to FIG. 14.

Figure 14A:
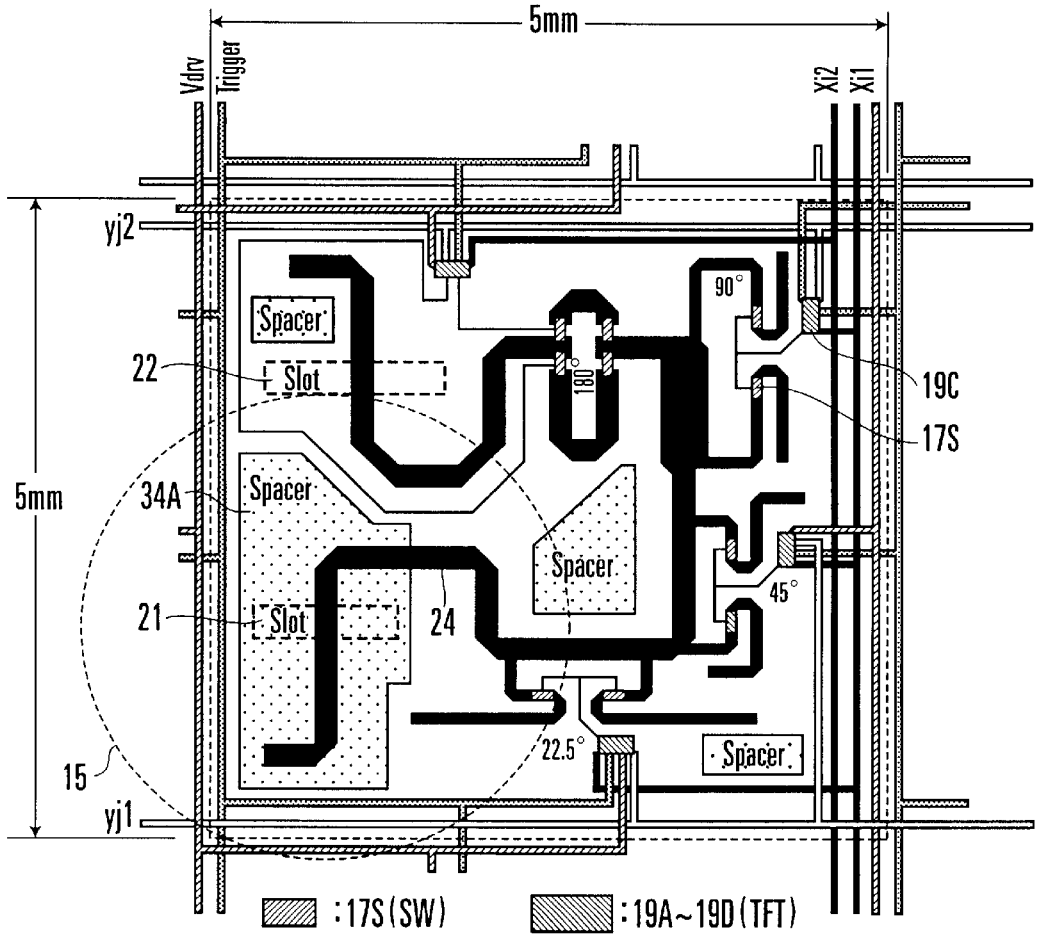
FIGS. 14A–14C show views of the circuit arrangement in Example 1.
Figure 14B:
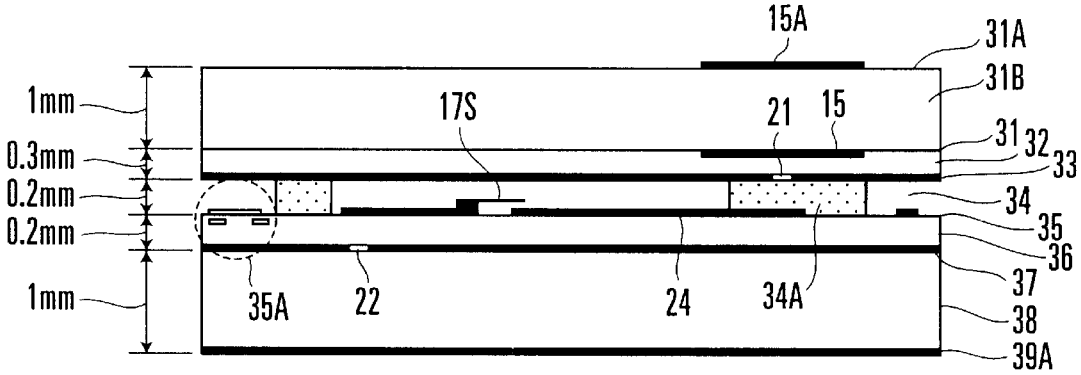
Figure 14C:
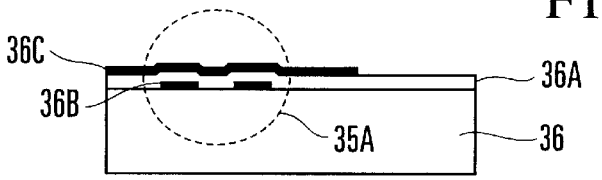

FIG. 14 shows views of a circuit arrangement of Example 1, in which FIG. 14(*a*) is a circuit diagram showing the arrangement of a phase control layer in the whole phase shift unit, FIG. 14(*b*) is a schematic view showing a multilayered structure, and FIG. 14(*c*) is an enlarged schematic view of an intersection between a signal and scanning lines wired on a phase control layer 35.

As shown in FIG. 14(*a*), a phase shift unit 16 is arranged in correspondence with each of radiating elements 15 arranged in an array and formed within a substantially square (5 mm×5 mm) region (see a broken-line square shown in FIG. 14(*a*)).

In particular, surrounding the phase shift unit 16, signal lines Xi1 and Xi2 extending from a signal line driver 12X, scanning lines Yj1 and Yj2 extending from a scanning line selector 12Y, a trigger signal line Trg extending from a control unit 11, and a switch driving power line Vdrv are arranged in a matrix.

In an internal region defined by the wiring lines, a strip line 24 for connecting an upper portion via a coupling slot 22 to a lower portion via a coupling slot 21 is arranged.

Phase shift circuits for 22.5°, 45°, 90°, and 180° and driver circuits corresponding to the respective phase shift circuits are arranged midway along the microstrip line 24.

The phase shift circuits and driver circuits 19A to 19D are simultaneously formed on one surface of a single substrate. (glass substrate) as the phase control layer 35.

The radiating element 15 (broken narrow line shown in FIG. 14(*a*)) having a diameter of 2.5 mm to 4 mm is arranged on a radiating element layer 31 above the coupling slot 21.

FIG. 14(*b*) shows the multilayered structure in Example 1, and the same reference numerals as in FIG. 12 denote the same parts.

Note that FIG. 14(*b*) schematically shows the multilayered structure, but does not show a specific section in FIG. 14(*a*).

The multilayered structure of this example is obtained by sequentially stacking from the bottom to top in FIG. 14(*b*), a ground layer 39A, a dielectric layer 38 (1 mm thick) in which a radial waveguide is formed, a ground layer 37, a dielectric layer 36 (0.2 mm thick), the phase control layer 35, a dielectric layer 34 (0.2 mm thick), a ground layer 33 in which the coupling slot 21 is formed, a dielectric layer 32 (0.3 mm thick), the radiating element layer 31, a dielectric layer 31B (1 mm thick), and a passive element layer 31A.

In this structure, the dielectric layer 34 between the phase control layer 35 and ground layer 33 has a space ensured by 0.2-mm thick spacers 34A, and switches 17S are formed at once on the phase control layer 35.

In this case, the spacer 34A may be arranged below the coupling slot 21. With this arrangement, a space immediately under the coupling slot 21, which generally an unused region, also serves as a region in which the spacer 34A is arranged, thereby reducing the area occupied by the spacer 34A.

As the spacer 34A, a material having high relative dielectric constant of about 5 to 30 such as alumina may be used and arranged under the coupling slot 21. Thus, the coupling slots 21 and the strip lines 24 on the phase control layer 35 are efficiently coupled in a high-frequency manner.

FIG. 14(*c*) shows an enlarged view of a portion at which the scanning lines Yj1 and Yj2 wired in the horizontal direction intersect the signal lines Xi1 and Xi2, trigger signal line Trg, and switch driving power line Vdrv wired in the vertical direction. This structure can be obtained by forming a wiring line 36B on the dielectric layer 36 in advance, applying an insulating film 36A to the entire surface of the dielectric layer 36, and then forming a wiring line 36C.

Assume that, in particular, a glass substrate is used as the dielectric layer 36, and the phase control layer is made of a thin-film transistor and formed on the dielectric layer 36. In this case, the wiring line 36B is formed at the same time a gate electrode made of the thin-film transistor is formed, and a silicon oxide film or the like is formed on the entire surface of the glass substrate as the insulating film 36A by sputtering. After that, the wiring line 36C is formed at the same time a source and drain electrodes of the thin-film transistor are formed.

The wiring lines in the vertical and horizontal directions are simultaneously formed on the dielectric layer 36 in advance, and a zero-ohm jumper resistor can be used to prevent interference at the intersection between the control signal lines.

Example 2 of the present invention will be described below with reference to FIG. 15.

Figure 15A:
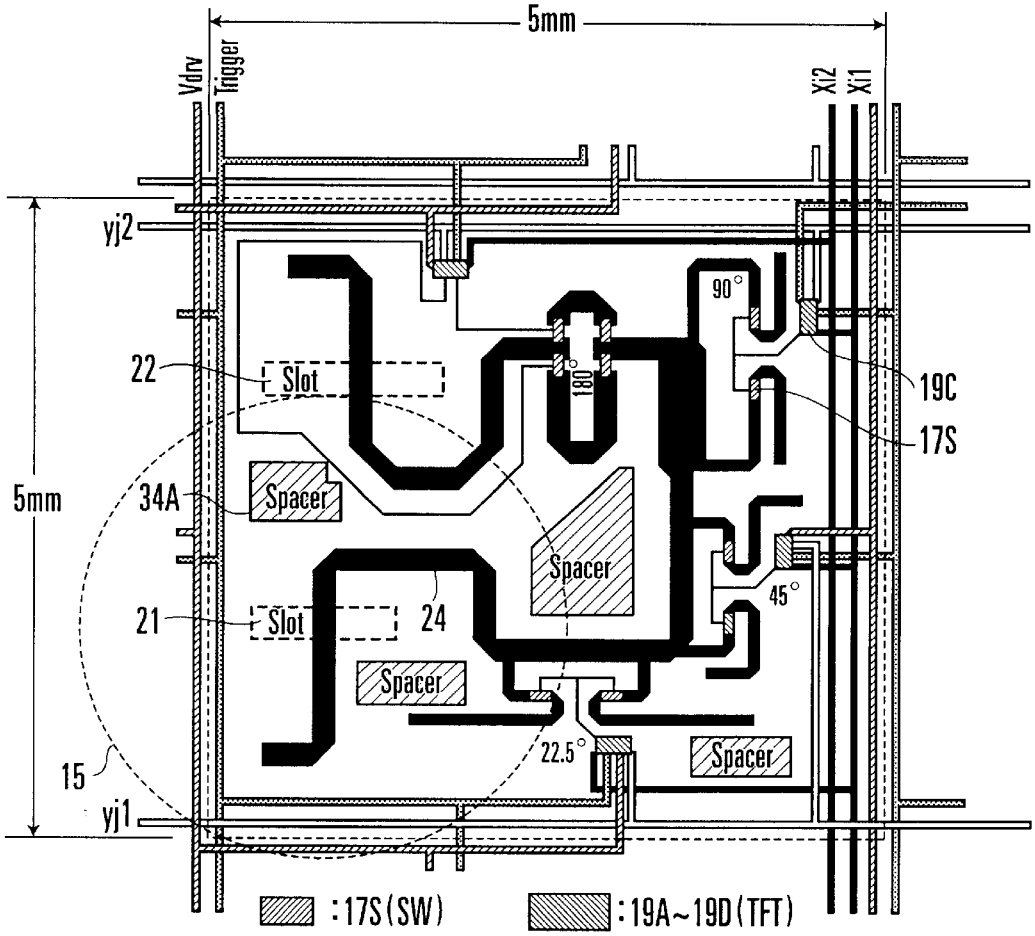
FIGS. 15A–15C show views of the circuit arrangement in Example 2.
Figure 15B:
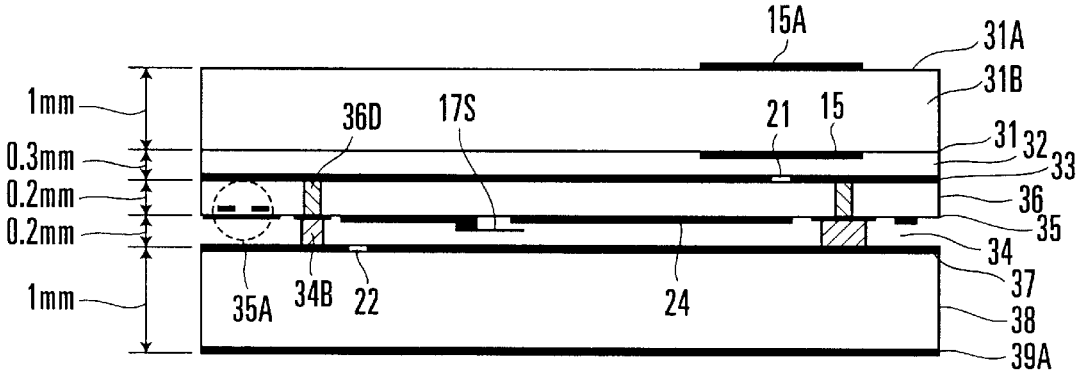
Figure 15C:
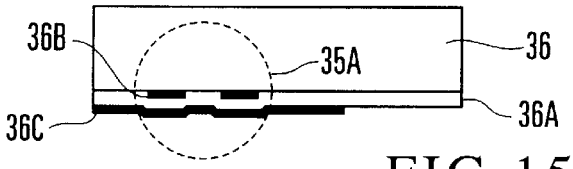

FIG. 15 shows views of the circuit arrangement of Example 2, in which FIG. 15(*a*) is a circuit diagram showing the arrangement of a phase control layer in the whole phase shift unit, FIG. 15(*b*) is a schematic view showing a multilayered structure, and FIG. 15(*c*) is an enlarged schematic view of an intersection between a signal and scanning lines wired on a phase control layer 35.

In Example 2, as shown in FIG. 12(*b*), switches 17S are formed at once on the phase control layer 35 and integrated with a dielectric layer 36 formed on a coupling layer 33, and a space serving as a mounting space for the switches 17S is ensured by a spacer 34A.

In this case, the switch 17S faces downward.

In Example 1, the spacer 34A having a high dielectric constant has been used, and a spacer made of a conductor is used in Example 2 shown in FIG. 15.

In this case, the conductive spacer is arranged at a position of a via hole (connection hole) formed on the dielectric layer 36, in which ground patterns, e.g., ground patterns of a coupling layer 37 and the coupling layer 33 are electrically connected to each other.

With this structure, an inter-ground-plate unnecessary mode (a parallel-plate mode) can be suppressed without individually forming any means which couples ground potentials with each other.

Note that in Example 1, a conductor can be used as the spacer 34A by forming a via hole 36A in the dielectric layer 36, and in Example 2, a dielectric can be used as the spacer 34A without forming the via hole 36A in the dielectric layer 36. Both cases can obtain the same effects.

Example 3 of the present invention will be described below with reference to FIG. 16.

Figure 16A:
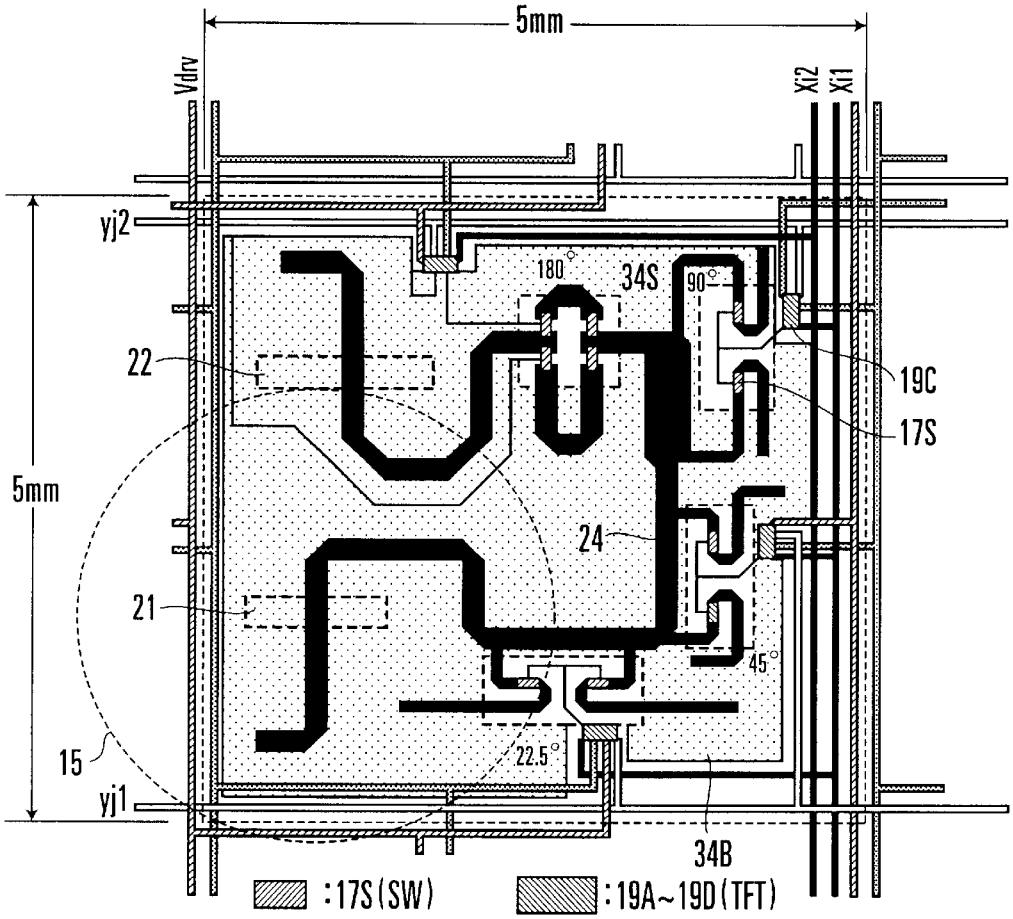
FIGS. 16A–16C show views of the circuit arrangement in Example 3.
Figure 16B:
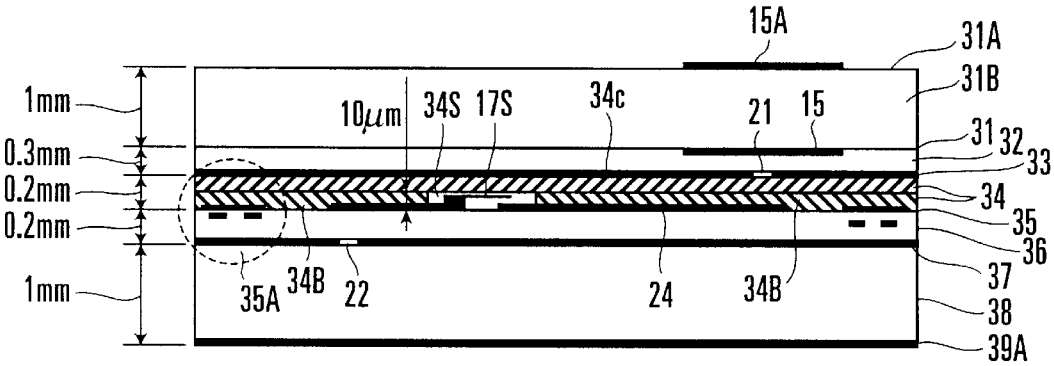
Figure 16C:
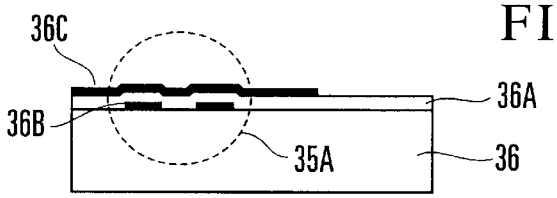

FIG. 16 shows views of the circuit arrangement of Example 3, in which FIG. 16(*a*) is a circuit diagram showing the arrangement of a phase control layer in the whole phase shift unit, FIG. 16(*b*) is a schematic view showing a multilayered structure, and FIG. 16(*c*) is an enlarged schematic view of an intersection between a signal and scanning lines wired on a phase control layer 35.

In this structure, as shown in FIG. 13(*a*), a space serving as a mounting space for switches 17S is ensured by a dielectric film 34B (10 mm thick).

In particular, a dielectric layer 34 is made up of only the dielectric film 34B in FIG. 13(*a*). In Example 3, a substrate 34C is inserted between the dielectric film 34B and a coupling layer 33.

When the necessary distance between the phase control layer 35 and the coupling layer 33 is considerably larger than the height of the switch 17S, a dielectric layer 34 portion above the height of the space for receiving the switch 17S is constructed by the substrate 34C.

With this structure, the dielectric film 34B is suppressed thin, thereby easily forming the dielectric film 34B.

A dielectric (e.g., relative dielectric constant=5 to 30) is used as the substrate 34C so that an RF signal from a strip line 24 on the phase control layer 35 is efficiently coupled with a radiating element 15 via a coupling slot 21.

Example 4 of the present invention will be described below with reference to FIG. 17.

Figure 17A:
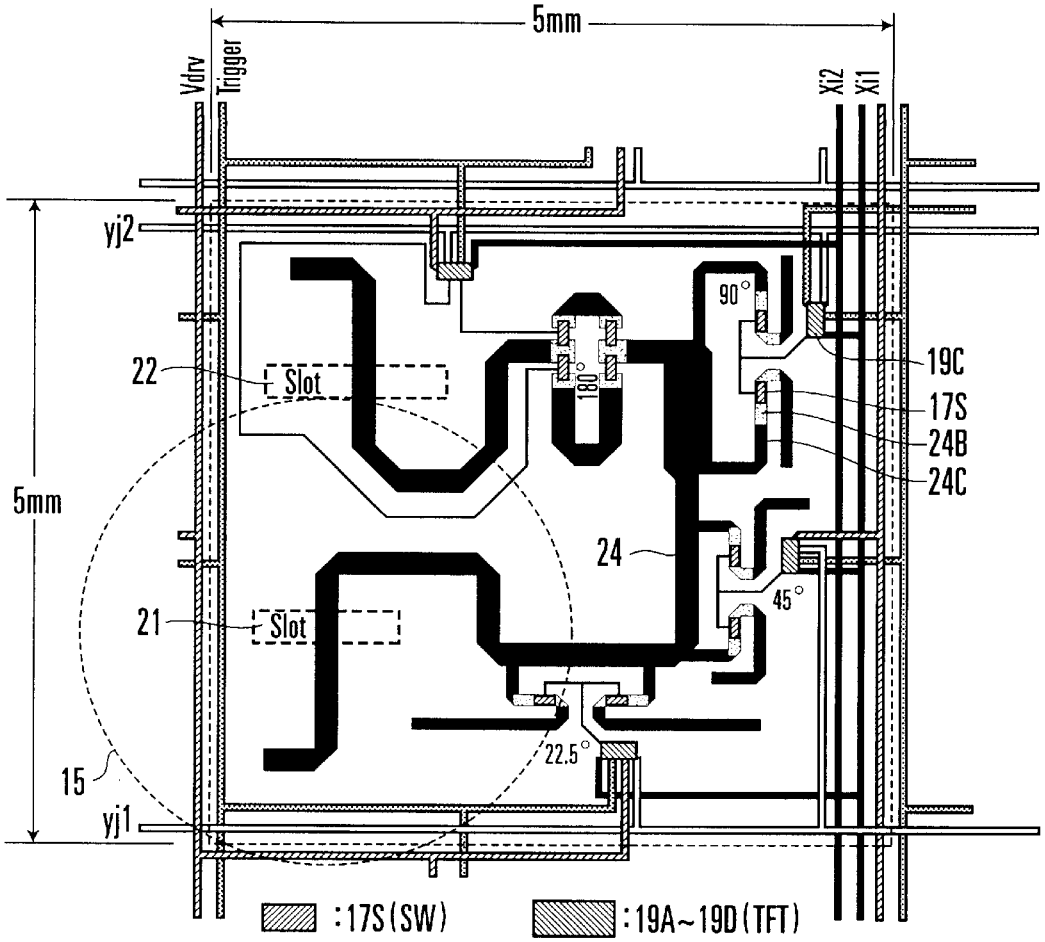
FIGS. 17A–17C show views of the circuit arrangement in Example 4.
Figure 17B:
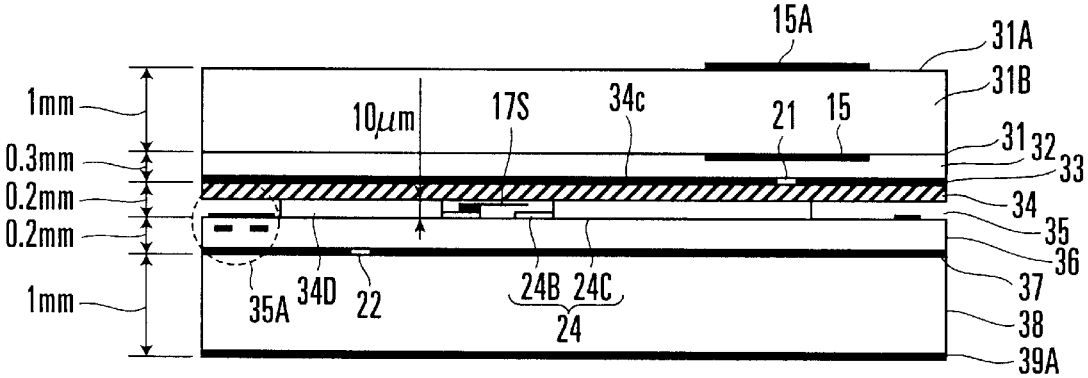
Figure 17C:
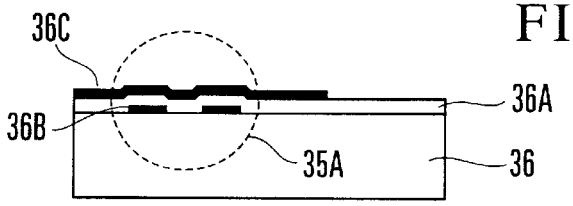

FIG. 17 shows views of the circuit arrangement of Example 4, in which FIG. 17(*a*) is a circuit diagram showing the arrangement of a phase control layer in the whole phase shift unit, FIG. 17(*b*) is a schematic view showing a multilayered structure, and FIG. 17(*c*) is an enlarged schematic view of an intersection between a signal and scanning lines wired on a phase control layer 35.

In Example 4, as shown in FIG. 13(*b*), a space serving as a mounting space for switches 17S is ensured by the thickness of the wiring pattern of the phase control layer 35.

In this structure, a wiring pattern 24B which is a part of a strip line 24 is formed by plating it thick to have a thickness larger than the height of the switch 17S.

A substrate 34C is inserted between the thick-film wiring pattern 24B and a coupling layer 33.

A high dielectric (e.g., relative dielectric constant=6 to 8) is used as the substrate 34C so that an RF signal from the strip line 24 of the phase control layer 35 is efficiently coupled with a radiating element 15 via a coupling slot 21.

Example 5 of the present invention will be described below with reference to FIG. 18.

Figure 18A:
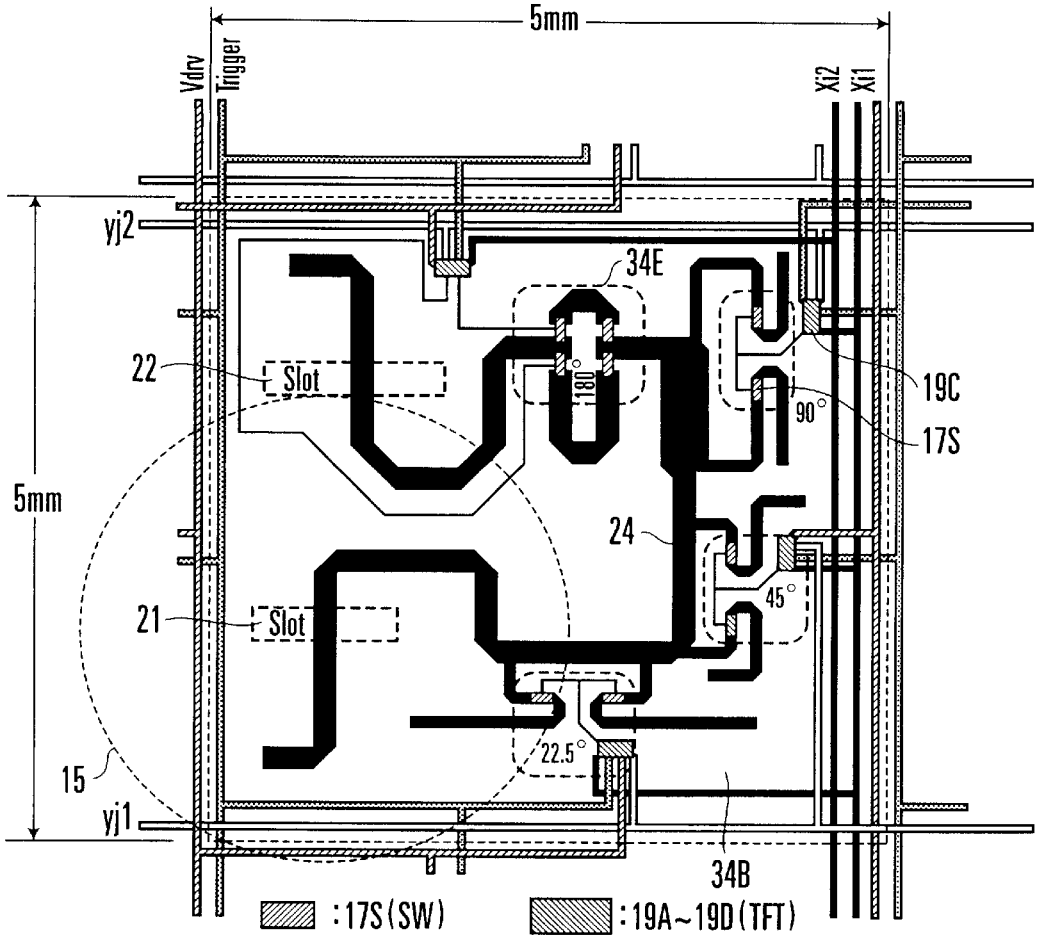
FIGS. 18A–18C show views of the circuit arrangement in Example 5.
Figure 18B:
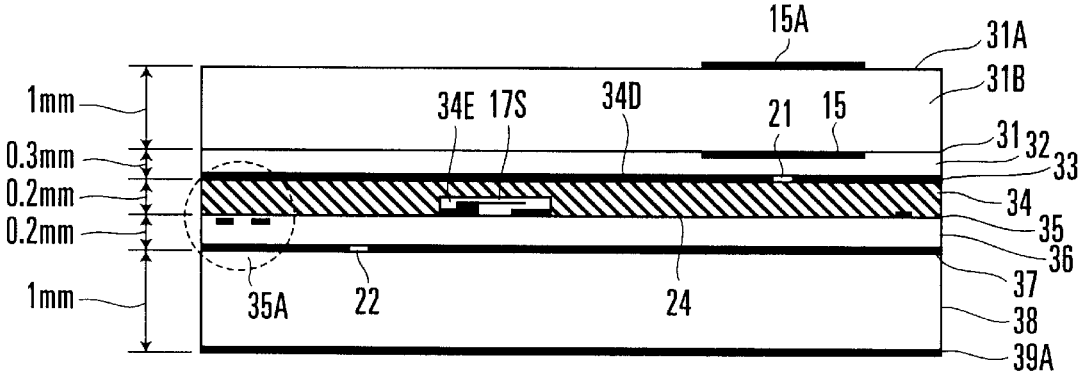
Figure 18C:
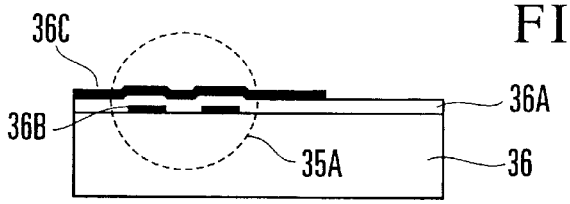
Figure 19:
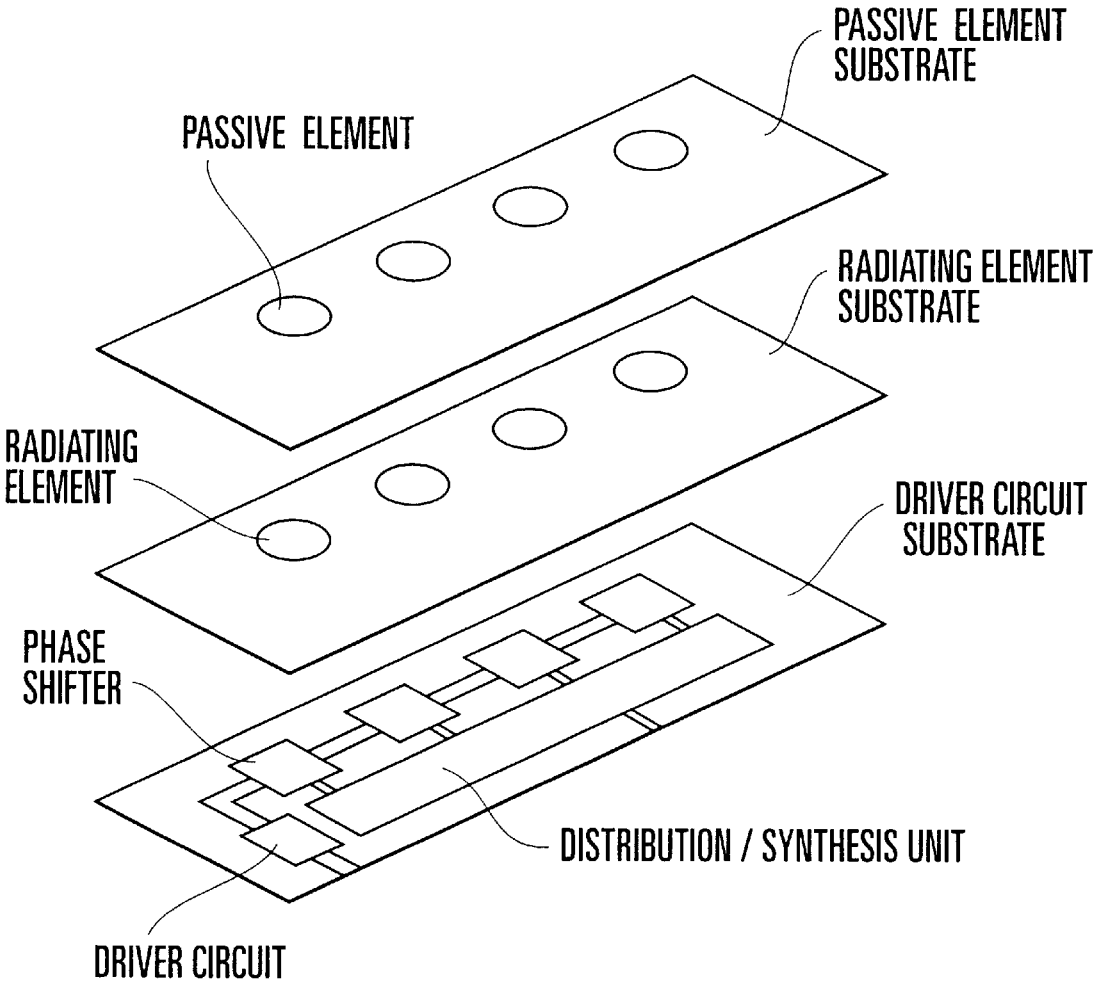
FIG. 19 is a view for explaining a conventional phased array antenna.

FIG. 18 shows views of the circuit arrangement of Example 5, in which FIG. 18(*a*) is a circuit diagram showing the arrangement of a phase control layer in the whole phase shift unit, FIG. 18(*b*) is a schematic view showing a multilayered structure, and FIG. 18(*c*) is an enlarged schematic view of an intersection between a signal and scanning lines wired on a phase control layer 35.

In Example 5, as shown in FIG. 13(*c*), a space serving as a mounting space for switches 17S is ensured by a substrate 34D (10 $\mu$m thick) having a cavity 34E.

In this structure, the cavity 34E is formed at the position, in the substrate 34D, at which the switch 17S is mounted on the phase control layer 35, and the switch 17S is housed in the cavity 34E when the substrates are tightly bonded.

A high dielectric (e.g., relative dielectric constant=6 to 8) is used as the substrate 34D so that an RF signal from a strip line 24 of the phase control layer 35 is efficiently coupled with a radiating element 15 via a coupling slot 21.

As a method of forming the cavity 34E in the substrate 34D, machining in which the surface of the substrate 34D is cut using a router or in which a through hole is formed by punching may be used.

Alternatively, after a photosensitive resin is applied on an organic substrate, the resin corresponding to the cavity 34E may be removed by exposing and developing processes. Various types of the formation methods are usable.

As described above, the case wherein a radial waveguide is adopted as a distribution/synthesis unit 14 is described with reference to FIGS. 14 to 18. However, the form shown in FIG. 2, i.e., a distribution/synthesis layer 39 using the branch strip line may also be used.

In addition, as described above, the present invention can also be applied to a stacking order different from that in the examples in FIGS. 14 to 18.

For example, the multilayered structure is obtained by sequentially stacking from the bottom to top, a phase control layer 35, dielectric layer 36, coupling layer 37, dielectric layer 38A, distribution/synthesis layer 39, dielectric layer 38, coupling layer 33, dielectric layer 32, and radiating element layer 31, and the distribution/synthesis layer 39 and the phase control layer 35 can also be arranged as innermost and outermost layers, respectively.

In this case, as a means for coupling RF signals between the layers in this structure, for example, a feed pin extending through a hole formed in the dielectric layer 37 may connect the phase control layer 35 to the distribution/synthesis layer 39 in a high-frequency manner, and a feed pin extending along the coupling layer 37 and coupling layer 33 may also connect the phase control layer 35 to a radiating element 15.

In this manner, the phase control layer 35 is arranged as the outermost layer so that the stacked structure can be obtained regardless of the height of a phase shift unit 16.

In addition, as the form shown in FIG. 4, the radiation feeder 27 and the multilayered substrate unit 2 may be separately formed to use a space-fed system. By using this system, a layer functioning as the distribution/synthesis unit 14 (the distribution/synthesis layer 27 shown in FIG. 2 or the radial waveguide in Examples shown in FIGS. 14 to 18) can be excluded from the multilayered substrate unit 2.

INDUSTRIAL APPLICABILITY

The phased array antenna of the present invention is a high-gain antenna applicable to an RF band, and is effective for a satellite tracking on-vehicle antenna or satellite borne antenna used for satellite communication.

What is claimed is:

1. A method of manufacturing a phased array antenna used to transmit/receive an RF signal having a beam direction adjustable by controlling a phase of the RF signal transmitted/received by each radiation element, comprising the steps of:

patterning, by photolithography and etching, a phase control layer with plural phase shifting units, each phase shifting unit connected to a control signal line connecting to a signal driver, a control scanning line connecting to a scanning line selector, a first strip line connecting to a distribution/synthesis unit, and a second strip line connecting to a radiating element, the first strip line being connected to the second strip line via the phase shifting unit; and patterning, by photolithography and etching, a radiating element layer, the radiating element layer comprising plural radiation elements operatively connected via the second strip lines to corresponding ones of the phase shifting units for controlling the phase of the RF signal transmitted/received to/from each radiation element, the phase control layer and the radiating element layer forming stacked layers; and bonding the stacked layers to each other, wherein all of the phase shifting units are simultaneously formed.

2. A method of manufacturing a phased array antenna according to claim 1, wherein, each of the phase shifting units comprise a phase control unit and a phase shifter, each phase control unit comprises plural driver circuits, each phase shifter comprises plural RF switches, each phase control unit is made up of a plurality of driver circuits connected to plural RF switches of the corresponding phase shifter, the driver circuits are connected to the control signal lines and the control scanning lines, outputs of the plural driver circuits of each phase shifting unit engage the RF switches to connect the distribution/synthesis unit to the radiating elements corresponding to the phase shifting units through distributed constant lines, formed by the RF switches connecting the first strip lines with the second strip lines, and the distributed constant lines have lengths corresponding to the phase shift amounts in accordance with the outputs from the driver circuits.

3. A method of manufacturing a phased array antenna according to claim 2, wherein, the driver circuit is made of a thin-film transistor, and the RF switch is comprised of a micromachine switch for electrically connecting/releasing the first and second strip lines to/from each other through a contact supported apart from the first and second strip lines by electrically or magnetically operating the contact.

4. A method of manufacturing a phased array antenna according to claim 3, wherein, the thin-film transistor and the micromachine switch are simultaneously formed on a substrate by a semiconductor device manufacturing process.

5. A method of manufacturing a phased array antenna according to claim 4, wherein, the substrate is formed of glass.

6. A method of manufacturing a phased array antenna according to claim 3, wherein, in forming the thin-film transistor, there includes:

a step of forming a gate electrode of the thin-film transistor on a substrate, a step of forming an insulating film on the gate electrode, a step of forming a semiconductor layer on the insulating film, a step of forming source and drain electrodes, a step of forming the scanning and signal lines for controlling the driver circuit, a step of forming the first and second strip lines of the micromachine switch and an electrode formed between the first and second strip lines, a step of forming a support member for supporting the contact, the step of selectively growing an electrolytic-plating portion to the first and second strip lines, a step of forming a sacrificial layer, and a step of forming the contact on the sacrificial layer.

7. A method of manufacturing a phased array antenna according to claim 6, wherein, the sacrificial layer is made of polyimide.

8. A method of manufacturing a phased array antenna according to claim 3, wherein, in the step of forming the phase control layer, a gate electrode of the thin-film transistor is formed on a substrate at the same time the signal lines and the scanning lines are formed on the substrate, the signal lines and the scanning lines form a matrix, an insulting film is formed on the gate electrode, a semiconductor layer is formed on the insulating film, and source and drain electrodes are formed, the source and drain electrodes of the thin-film transistor are formed at the same time the first and second strip lines of the micromachine switch, an electrode is arranged at a gap between the first and second strip lines simultaneously with forming a support member for supporting the contact, an electrolytic-plating portion is grown to the first and second strip lines, a sacrificial layer is formed, and the contact is formed on the sacrificial layer.

9. A phased array antenna used to transmit/receive an RF signal having a beam direction adjustable by controlling a phase of the RF signal transmitted/received by each radiation element, comprising a multilayered structure of at least:

a radiation element layer comprising plural radiation elements arranged;

a phase control layer comprising plural phase shifting units for controlling the phase of the RF signal transmitted/received to/from each radiation element, each phase shifting unit connected to a control signal line connecting to a signal line driver and to a control scanning line connecting to a scanning line selector, the control signal lines and control scanning lines being arranged in a matrix, and the phase shifting units co-planar with one another on the phase control layer; and a control unit configured to sequentially set a phase control by holding data given to the signal lines in accordance with selection of the scanning lines.

10. A phased array antenna according to claim 9, further comprising a first coupling layer arranged between the phase control layer and the radiating element layer, the first coupling layer coupling signals from the phase control layer to the radiating element layer.

11. A phased array antenna according to claim 9, wherein, the phase control layer further comprises an internal space, the plural phase shifting units having an upper surface contacting the internal space.

12. A phased array antenna according to claim 9, wherein, the phased array antenna further comprises a distribution/synthesis unit for distributing a transmission signal to each phase control shifting unit and synthesizing a reception signal from each phase shifting unit.

13. A phased array antenna according to claim 9, wherein, the phase shifting units comprise a plurality of driver circuits for respectively driving RF switches upon receiving on the signal lines and scanning lines the phase shift changes, and driver circuits connected to the RF switches, the RF switches configuring distributed constant lines with lengths corresponding to the phase shift amounts in accordance with outputs from the driver circuits.

14. A phased array antenna according to claim 13, wherein, the driver circuits comprise thin-film transistors.

15. A phased array antenna according to claim 13, wherein, each of the driver circuits comprises a first latch for latching a voltage level of the signal line based on a voltage level of the scanning line, and a second latch for latching an output level of the first latch based on a trigger signal to give the output level to the RF switch.

16. A phased array antenna according to claim 15, wherein, the trigger signal is a pulse signal.

17. A phased array antenna according to claim 15, wherein, the driver circuits comprise two latches and the trigger signal is always output to the second latch.

18. A phased array antenna according to claim 13, wherein, the RF switch is comprised of a micromachine switch for electrically connecting/releasing the first and second strip lines to/from each other through a contact supported apart from the first and second strip lines by electrically or magnetically operating the contact.

19. A phased array antenna according to claim 9, wherein, the radiating element is a patch or slot antenna.

20. A phased array antenna according to claim 12, wherein, the distribution/synthesis unit is comprised of a distribution/synthesis layer having a branch circuit using a strip line or a radial waveguide using a metal enclosure with an internal space, and the distribution/synthesis layer is coupled to the phase control layer via a coupling layer.

21. A phased array antenna according to claim 12, wherein, the distribution/synthesis unit is comprised of a primary radiation unit for performing space feeding.

22. A phased array antenna according to claim 10, wherein, the first coupling layer comprises coupling slots or conductive feed pins.

23. A phased array antenna according to claim 20, wherein the coupling layer comprises coupling slots or conductive feed pins.

24. A phased array antenna according to claim 18, further comprising a space located in contact with the phase shifting units, the space having a height larger than a maximum height of the contact from a bottom surface of the micromachine switch.

25. A phased array antenna according to claim 11, wherein, the predetermined height is defined by a dielectric spacer formed on the phase control layer.

26. A phased array antenna according to claim 25, further comprising a first coupling layer arranged between the phase control layer and the radiating element to couple the RF signals; and a dielectric spacer formed below a coupling slot of the first coupling layer.

27. A phased array antenna according to claim 11, wherein the predetermined height is defined by a conductive spacer formed on the phase control layer.

28. A phased array antenna according to claim 24, wherein, the predetermined height is defined by a sacrificial layer used to form the micromachine switch, and a dielectric film is formed on the sacrificial layer.

29. A phased array antenna according to claim 24, wherein the predetermined height is defined by a wiring pattern conductor.

30. A phased array antenna according to claim 11, wherein, the predetermined height is defined by a cavity formed by partially removal of a dielectric layer formed on the phase control layer.

31. A phased array antenna used to transmit/receive an RF signal having a beam direction controlled by a phase of the RF signal transmitted/received by each radiation element, comprising a multilayered structure of:

a phase control layer on which each phase control means for controlling the phase of the RF signal transmitted/received to/from each radiating element are formed;

a radiating element layer on which plural radiating elements are arranged;

a first coupling layer intermediate the phase control layer and the radiating element layer for coupling RF signals therebetween;

a passive element layer stacked on the radiating element layer, the phase control means connecting to and phase-controlled on the basis of signal lines and scanning lines arranged in a matrix; and a control unit configured to sequentially set a phase control by holding data given to the signal lines in accordance with selection of the scanning lines, the phase control means being co-planar with one another on the phase control layer.

32. A phased array antenna according to claim 31, further comprising:

a first dielectric layer formed between the phase control layer and the coupling layer;

a second dielectric layer formed between the coupling layer and the radiating element layer; and a third dielectric layer formed between radiating element layer and the passive element layer.

33. A phased array antenna according to claim 32, wherein, one of the dielectric layers is made of glass.

* * * * *